US008911048B2

(12) United States Patent
Yamada et al.

(10) Patent No.: US 8,911,048 B2
(45) Date of Patent: Dec. 16, 2014

(54) IMAGE PROCESSOR AND IMAGE PROCESSING METHOD HAVING CORRECTING UNIT PERFORMING CORRECTION BASED ON CORRECTION PARAMETERS

(75) Inventors: Akitoshi Yamada, Yokohama (JP); Ryosuke Iguchi, Kawasaki (JP); Nobutaka Miyake, Yokohama (JP); Tohru Ikeda, Yokohama (JP); Mitsuhiro Ono, Tokyo (JP); Fumitaka Goto, Tokyo (JP); Hidetsugu Kagawa, Kawasaki (JP); Tomokazu Ishikawa, Kawasaki (JP); Junichi Nakagawa, Tokyo (JP); Senichi Saito, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 36 days.

(21) Appl. No.: 12/963,657

(22) Filed: Dec. 9, 2010

(65) Prior Publication Data

US 2012/0081436 A1 Apr. 5, 2012

(30) Foreign Application Priority Data

Oct. 5, 2010 (JP) ..... 2010-225745

(51) Int. Cl.
*B41J 29/38* (2006.01)
*B41J 2/21* (2006.01)

(52) U.S. Cl.
CPC ..... *B41J 2/2139* (2013.01)
USPC ..... 347/14

(58) Field of Classification Search
None
See application file for complete search history.

(56) References Cited

U.S. PATENT DOCUMENTS

| | | | | |
|---|---|---|---|---|
| 6,025,929 | A * | 2/2000 | Nakajima et al. | 358/1.9 |
| 6,215,968 | B1 * | 4/2001 | Uehara et al. | 399/49 |
| 6,390,583 | B1 * | 5/2002 | Kato et al. | 347/15 |
| 6,450,606 | B1 | 9/2002 | Kato et al. | |
| 6,474,768 | B1 * | 11/2002 | Yano et al. | 347/19 |
| 6,494,557 | B1 * | 12/2002 | Kato et al. | 347/19 |
| 6,505,909 | B1 * | 1/2003 | Kato et al. | 347/19 |

FOREIGN PATENT DOCUMENTS

| | | |
|---|---|---|
| JP | 04-062063 A | 2/1992 |
| JP | 04-072869 A | 3/1992 |

(Continued)

OTHER PUBLICATIONS

Office Action in Japanese Patent Application No. 2010-225745, dated Apr. 8, 2014.

*Primary Examiner* — Lam Nguyen
*Assistant Examiner* — Bradley Thies
(74) *Attorney, Agent, or Firm* — Fitzpatrick, Cella, Harper & Scinto

(57) ABSTRACT

When printing an image using a plurality of inks, color unevenness caused by variations in ejection characteristics among nozzles is corrected at suitable timings in accordance with change in the color unevenness over time, and favorable image output without noticeably color unevenness is maintained. For this purpose, parameters are prepared, for colors formed by combinations of at least two colors of ink, the parameters being determined so as to reduce differences in coloration on a print medium caused by individual variations in the ejection characteristics of a plurality of nozzles. When printing, a first color signal included in individual pixels is corrected for a second color signal by using the parameters. Information regarding the ejection volume characteristics of a plurality of nozzles is acquired as appropriate, and by estimating changes in coloration from this information, suitable timings for overwriting such parameters are determined.

12 Claims, 13 Drawing Sheets

(56) References Cited

FOREIGN PATENT DOCUMENTS

| | | | |
|---|---|---|---|
| JP | 10-013674 | | 1/1998 |
| JP | 2006-116800 | A | 5/2006 |
| JP | 2008-153871 | A | 7/2008 |
| JP | 2010-023281 | A | 2/2010 |

* cited by examiner

IMAGE PROCESSOR AND IMAGE PROCESSING METHOD HAVING CORRECTING UNIT PERFORMING CORRECTION BASED ON CORRECTION PARAMETERS

BACKGROUND OF THE INVENTION

1. Field of the Invention

The present invention relates to an image processor and an image processing method. More particularly, the present invention relates to an image processor configured to decrease color unevenness caused by individual variations in the ejection characteristics of a plurality of nozzles that eject ink.

2. Description of the Related Art

In print heads used in inkjet printing apparatus, individual variations are sometimes exhibited in the ejection characteristics (i.e., the ejection volume and ejection direction, for example) of a plurality of nozzles, due to manufacturing errors and other factors. When such variation exists, printed images become more susceptible to density unevenness.

In the related art, one established process for decreasing such density unevenness involves using head shading technology such as that disclosed in Japanese Patent Laid-Open No. H10-013674 (1998). Head shading is a technology that corrects image data according to information regarding the ejection characteristics of individual nozzles. By means of such correction, the number of ink dots that are ultimately printed is increased or decreased for each nozzle, and the concentration (density) in the printed image can be made nearly uniform across the nozzles.

However, when head shading technology as described above is used, if two or more inks are combined for color reproduction, then a phenomenon will occur wherein the coloring in the areas printed with the nozzles having non-standard ejection volumes will differ from the colors that should be printed. In other words, the above might cause inaccurate color, herein referred to as color deviation.

By way of example, consider the case of printing a blue image using nozzles exhibiting standard ejection volumes for cyan ink, and greater-than-standard ejection volumes for magenta ink. In this case, the magenta ink with the greater-than-standard ejection volumes will form dots on the print medium that are larger than the cyan dots. If such a print head is corrected by means of head shading (i.e., an HS process), then magenta will be printed using fewer dots than the standard number of dots. In other words, the number of magenta dots will be less than the number of cyan dots. As a result, the blue image regions will contain a mixture of solid cyan dots of standard size, as well as overlapping dots wherein cyan dots are printed inside larger magenta dots. The coloring in such regions will be different from the coloring in a blue image printed using cyan dots and magenta dots of standard size and number. This occurs because the ratio of the print medium occupied by solid cyan, the ratio occupied by solid magenta, and the ratio occupied by blue resulting from overlapping cyan and magenta, all differ between the above two images.

Such variation in the surface area ratios occupied by respective colors occurs not only because of variation in ejection volume, but also because of variation in ejection direction. In other words, even if density unevenness in solid cyan images or solid magenta images is resolved by the head shading of the related art, the variation in ejection characteristics will still lead to color deviation in blue images expressed by overlapping combinations of these colors. Furthermore, since the degree of color deviation differs among the regions printed by nozzles with different ejection characteristics, different shades of color are perceived in individual regions that should have the same coloring, which is noticed as color unevenness.

In addition, the ejection characteristics of the individual nozzles themselves change according to the frequency and cumulative number of ejections. This tendency is particularly large in Bubble Jet (registered trademark) print heads, wherein film boiling in the ink is produced as ejection energy, with the expansion pressure that accompanies the vaporization being utilized to eject ink. Thus, the tendency towards the color unevenness described above changes according to the frequency and cumulative number of ejections for each individual nozzle.

SUMMARY OF THE INVENTION

The present invention has been devised in order to solve the above problems. Consequently, it is an object of the present invention to correct color unevenness which is caused by individual variation in ejection characteristics among nozzles for according to change over time and, even in the case, to curtail the processing time, expended print media, and ink volume used in the case of printing an image using a plurality of inks as possible.

The first aspect of the present invention is an image processor which processes input image data for printing an image onto a print medium with the use of print heads provided with a plurality of nozzle arrays that eject ink of respectively different colors, the image processor comprising: a correcting unit configured to correct the input image data corresponding to individual regions of the print heads on the basis of correction parameters corresponding to the regions formed by dividing the respective nozzle arrays for at least two colors from among the plurality of nozzle arrays; a updating unit configured to update the correction parameters; an acquiring unit configured to acquire information regarding ejection characteristics of nozzles for each of the regions, on the respective nozzle arrays for at least two colors; and a determining unit configured to determine whether or not it is necessary for the updating unit to update the correction parameters on the basis of the information regarding the ejection characteristics that was acquired by the acquiring unit and the information regarding the ejection characteristics that has been acquired by the acquiring unit when the correction parameters were updated by the updating unit.

The second aspect of the present invention is an image processing method for processing input image data for printing an image onto a print medium with the use of print heads provided with a plurality of nozzle arrays that eject ink of respectively different colors, the image processing method comprising the steps of: correcting the input image data corresponding to individual regions of the print heads on the basis of correction parameters corresponding to the regions formed by dividing the respective nozzle arrays for at least two colors from among the plurality of nozzle arrays; updating the correction parameters; acquiring information regarding ejection characteristics of nozzles for each of the regions, on the respective nozzle arrays for at least two colors; and determining whether or not it is necessary to update the correction parameters in the updating step on the basis of the information regarding the ejection characteristics that was acquired in the acquiring step and the information regarding the ejection characteristics that has been acquired in the acquiring step when the correction parameters were updated in the updating step.

Further features of the present invention will become apparent from the following description of exemplary embodiments (with reference to the attached drawings).

DESCRIPTION OF THE EMBODIMENTS

Figure 1:
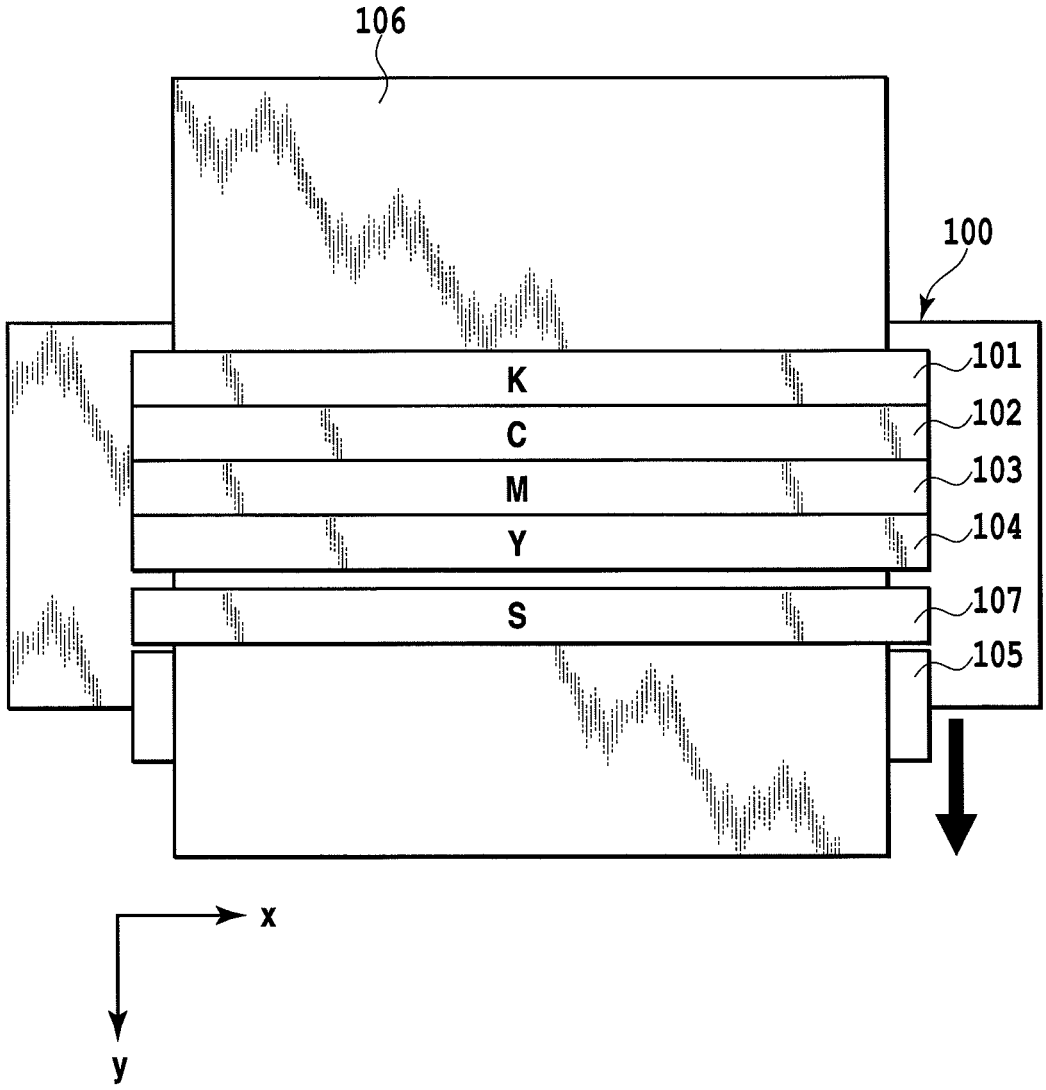
FIG. 1 schematically illustrates an inkjet printer in accordance with an embodiment of the present invention.

Hereinafter, embodiments of the present invention will be described in detail and with reference to the drawings. FIG. 1 schematically illustrates an inkjet printer in accordance with an embodiment of the present invention. The printer in the present embodiment is a full-line type printing apparatus, and as illustrated in FIG. 1, the printer is provided with four nozzle arrays 101 to 104 on a frame that acts as the printer's structural member. On each of the nozzle arrays 101 to 104, a plurality of nozzles ejecting the same type of ink is arranged along the X direction at a pitch of 1200 dpi and in accordance with the width of the printing paper 106. The nozzle arrays 101 to 104 eject black (K), cyan (C), magenta (M), and yellow (Y) ink, respectively. By arranging these nozzle arrays 101 to 104 ejecting multiple inks in the Y direction parallel to each other, the print heads of the present embodiment are realized.

The printing paper 106 herein acting as a print medium is conveyed in the Y direction orthogonal to the X direction in the drawings by a conveying roller 105 (as well as other rollers not illustrated), which rotates due to the driving force of a motor (not illustrated). While the printing paper 106 is being conveyed, the plurality of nozzles on each of the nozzle arrays 101 to 104 conduct ejection operations according to print data and at a frequency that corresponds to the conveying speed of the printing paper 106. In so doing, dots of respective colors are printed at a predetermined resolution in accordance with the print data, and a single-page image is formed on the printing paper 106.

At a position downstream to the nozzle arrays 101 to 104 in the Y direction, a scanner 107 is disposed, with scanning elements arranged at a predetermined pitch parallel to the nozzle arrays 101 to 104. The scanner 107 is able to scan the image printed by the nozzle arrays 101 to 104, and output the result as multi-valued RGB data.

It should be appreciated that a printing apparatus to which the present invention can be applied is not limited to the full-line type apparatus described above. For example, the present invention may also be applied to a serial type printing apparatus, wherein printing is conducted by scanning the print heads and scanner in the direction orthogonal to the conveying direction of the printing paper.

Figure 2:
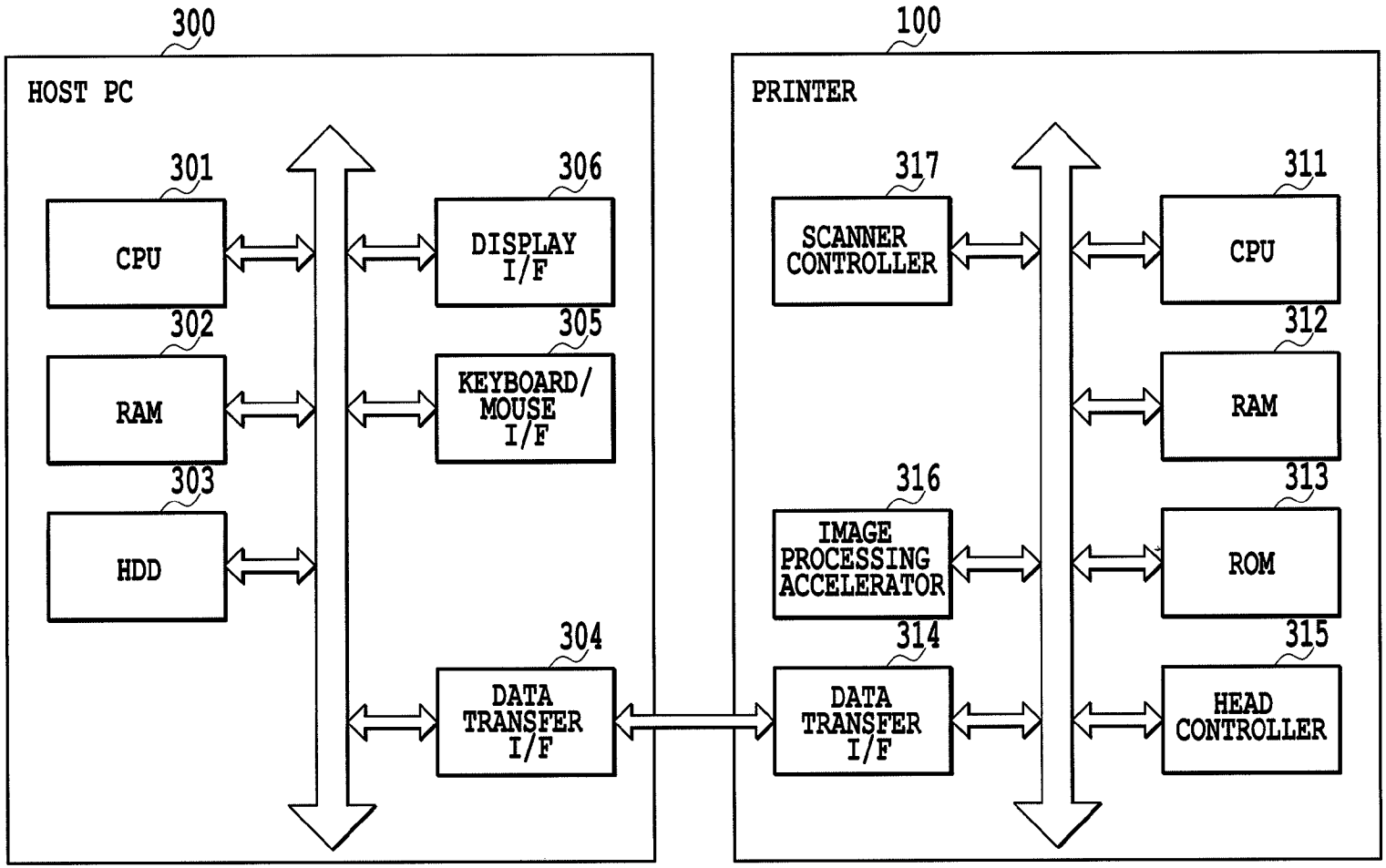
FIG. 2 is a block diagram illustrating a printing system in accordance with an embodiment of the present invention.

FIG. 2 is a block diagram illustrating a printing system in accordance with an embodiment of the present invention. As illustrated in FIG. 2, the printing system includes the printer 100 illustrated in FIG. 1, as well as a personal computer (PC) 300, which acts as a host device.

The host PC 300 primarily includes the following components. The CPU 301 executes processes according to programs stored in the HDD 303 and the RAM 302. The RAM 302 is volatile storage, and temporarily stores programs and data. The HDD 303 is non-volatile storage and similarly stores programs and data. In the present embodiment, the MCS data characteristic to the present invention and hereinafter described is also stored in the HDD 303. The data transfer interface (I/F) 304 controls the sending and receiving of data with respect to the printer 100. The connection protocol used for this sending and receiving of data may be USB, IEEE 1394, or LAN, for example. The keyboard/mouse I/F 305 is an I/F that controls a keyboard, mouse, or other human interface device (HID). Via this I/F, the user is able to input information. The display I/F 306 controls the display of information on a display (not shown).

Meanwhile, the printer 100 primarily includes the following components. Following programs stored in the ROM 313 and the RAM 312, the CPU 311 executes the processes of the respective embodiments hereinafter described. The RAM 312 is volatile storage, and temporarily stores programs and data. The ROM 313 is non-volatile storage, and is able to store programs and table data used in the processes hereinafter described.

The data transfer I/F 314 controls the sending and receiving of data with respect to the PC 300. The head controller 315 supplies print data to each of the nozzle arrays 101 to 104 illustrated in FIG. 1, and also controls the ejection operations of the print heads. More specifically, the head controller 315 may be configured to read control parameters and print data from particular addresses in the RAM 312. When the CPU 311 writes control parameters and print data to the particular addresses in the RAM 312, a process is launched by the head controller 315 and ink is ejected from the print heads. The scanner controller 317 controls the individual scanning elements of the scanner 107 illustrated in FIG. 1, while also outputting the RGB data obtained by these elements to the CPU 311.

The image processing accelerator 316 is hardware that is able to execute image processing faster than the CPU 311. More specifically, the image processing accelerator 316 is configured to read parameters and data relevant to image processing from particular addresses in the RAM 312. When the CPU 311 writes such parameters and data to the particular addresses in the RAM 312, the image processing accelerator 316 is activated, and the data is subjected to predetermined image processing. In the present embodiment, the parameters of a table used by an MCS processor to be hereinafter described are created by a process executed in software by the CPU 311. In contrast, image processing at the time of printing, including the processes of the MCS processor, are executed in hardware by the image processing accelerator 316. It should also be appreciated that the image processing accelerator 316 is not a required component, and that depending on the printer specifications and other factors, both the above process for creating table parameters as well as the image processing may be executed by the CPU 311 alone.

Given the printing system described above, the following will describe embodiments for decreasing color deviation caused by individual variations in the ejection characteristics of a plurality of nozzles when printing an image using a plurality of inks.

Figure 3A:
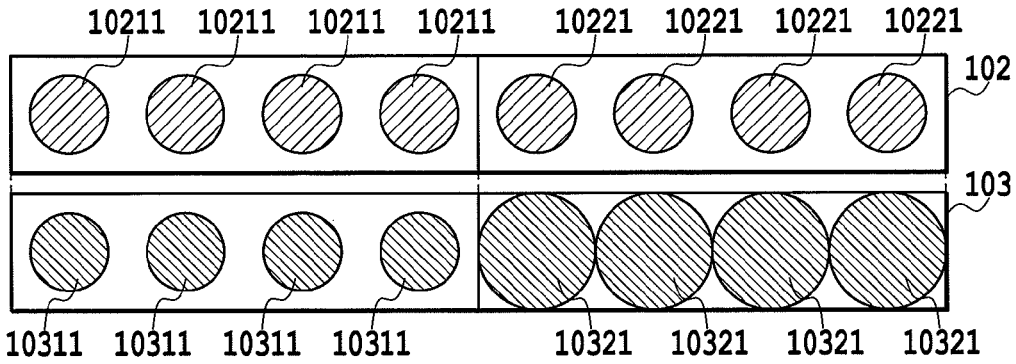
FIGS. 3A to 3C are diagrams for explaining how color unevenness is produced when printing a blue image after having conducted head shading of the related art.
Figure 3B:
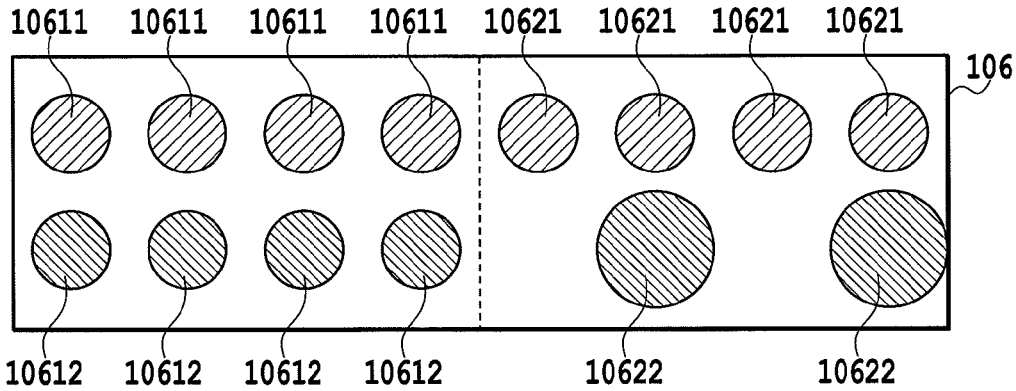
Figure 3C:
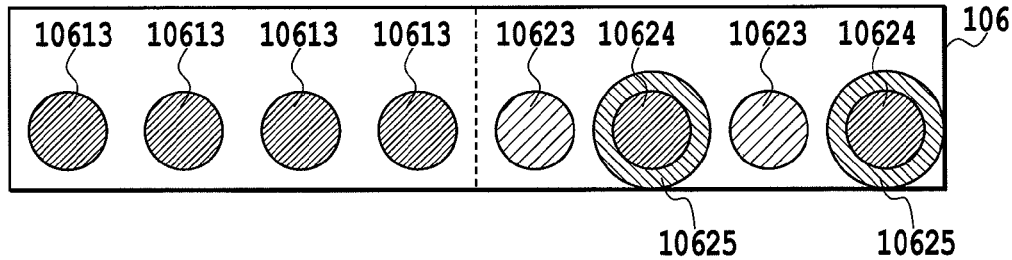

FIGS. 3A to 3C are diagrams for explaining how color deviation is produced when printing a blue image expressed by a combination of two inks after having conducted head shading of the related art. In FIG. 3A, 102 represents a print head that ejects cyan ink, and 103 represents a print head that ejects magenta ink. Also, for the sake of simplification in both illustration and description, only eight nozzles from among the plurality of nozzles in each print head are illustrated in FIG. 3A. Also, since color deviation will be described for the case of printing blue using cyan and magenta ink, only the two print heads for cyan and magenta are illustrated.

The eight nozzles 10211 and 10221 of the cyan ink print head 102 are all able to eject a standard volume of ink in a standard direction, and same-size dots are printed at equal intervals on the print medium. In contrast, although the ejection directions are all normal for the eight nozzles of the magenta print head 103, the four nozzles 10311 on the left side of FIG. 3A exhibit standard ejection volumes, while the four nozzles 10321 on the right side exhibit greater-than-standard ejection volumes. Consequently, whereas magenta dots equal in size to the cyan dots are printed in the area on the left side of FIG. 3A (the first area), magenta dots larger than the cyan dots are printed at fixed intervals equal to the cyan dots in the area on the right side (the second area).

If image data is corrected by the head shading of the related art when using print heads with such ejection characteristics, then the image data corresponding to the magenta nozzles 10321 will be corrected in a decreasing direction. As a result, dot data (i.e., binary data) specifying whether to print (1) or not print (0) individual dots will be generated such that the number of dots ultimately printed by the magenta nozzles 10321 becomes less than the number of dots printed by the magenta nozzles 10311.

FIG. 3B illustrates how dots are printed in the case where printing is conducted on the basis of dot data resulting from applying head shading correction to a solid image, or in other words, image data wherein both cyan and magenta have 100% duty. For the sake of explanation herein, FIG. 3B illustrates the cyan dots and magenta dots without overlapping. In FIG. 3B, 10611 represents dots printed onto the printing paper by the cyan nozzles 10211, and 10621 represents dots printed onto the printing paper by the cyan nozzles 10221. Also, 10612 represents dots printed onto the printing paper by the magenta nozzles 10311, and 10622 represents dots printed onto the printing paper by the magenta nozzles 10321. In FIGS. 3A to 3C herein, the size of the individual nozzles and the size of the dots printed by each nozzle are illustrated as being equal in size. However, it should be appreciated that the nozzles and dots are illustrated in this way in order to associate the two in the explanation herein, and that in practice the nozzles and dots are not equal in size.

FIG. 3B illustrates the case where the surface area of the dots formed on the printing paper by the magenta nozzles 10321 are double the surface area of the dots formed by the magenta nozzles 10221. In this case, reducing the number of ejections from the magenta nozzles 10321 to approximately ½ (i.e., from four dots to two dots) by head shading the surface area of the printed paper that is covered in magenta of the second area is able to be roughly equal to that of the first area. However, this example of reducing the number of double-area dots to ½ is given to simplify explanation. In actual practice, the relationship between the coverage area and the detected density is not necessarily proportional. Thus, with typical head shading, the number of dots printed in each area is adjusted so that the detected density becomes nearly uniform across all nozzle areas.

FIG. 3C illustrates the results of printing on the basis of dot data obtained by head shading, herein showing the printed state with the cyan dots and magenta dots overlapping each other. In FIG. 3C, in the first area of the printing paper 106, standard size cyan dots and magenta dots are printed overlapping each other, thereby forming standard size blue dots 10613. In contrast, in the second area, standard size cyan dots 10623 are mixed with blue dots formed by the overlap of standard size cyan dots with double-size magenta dots. Furthermore, the blue dots formed by the overlap of standard size cyan dots with double size magenta dots can be subdivided into two areas: a blue area 10624, where the cyan and the magenta are completely overlapping; and a surrounding magenta area 10625.

In the HS process, the numbers of printed dots are adjusted to make the following quantities equal to each other: the total surface area of the cyan areas (i.e., dots) 10623; the total surface area of the blue areas 10624; and the total surface area of the magenta areas 10625. Consequently, if the color observed as a result of the combination of the light absorption characteristics of the cyan areas 10623 with the light absorption characteristics of the magenta areas 10625 is equivalent to the color observed as a result of the light absorption characteristics of the blue areas 10624, then those areas will appear to be almost identical in color to the blue areas 10624. As a result, the blue image in the first area on the printing paper 106 will appear to be the same color as the blue image in the second area.

However, in cases where an area is formed by overlapping a plurality of different inks like the blue areas 10624, the color observed as a result of that area's light absorption characteristics will not necessarily match the color observed as a result of the combination of the light absorption characteristics in the respective areas of the plurality of inks. As a result, for the region as a whole, a color will be produced that is deviated from the standard color intended. This in turn causes the blue image in the first area of the printing paper 106 to be perceived as a different color from the blue image in the second area.

Consider also multi-value printing apparatus wherein the dot size can be changed, such as 4-value printing apparatus that print using three-stage dots (large, medium, and small), for example. Such apparatus are also susceptible to individual variations in the largeness of dots at the respective sizes, due to individual variations in ejection volumes among the nozzles. In these cases, color deviation might still be produced due to reasons similar to the above, even if correction is performed by means of the head shading of the related art. Consequently, the present invention is not limited to 2-value printing apparatus, and may also be applied to multi-value (larger than 3-value) printing apparatus.

In the embodiment of the present invention described hereinafter, color deviation like that described earlier is decreased by means of a correction process applied to image data made up of combinations of multiple color signals before quantization.

First Embodiment

Figures 4A, 4B, 4C, 4D:
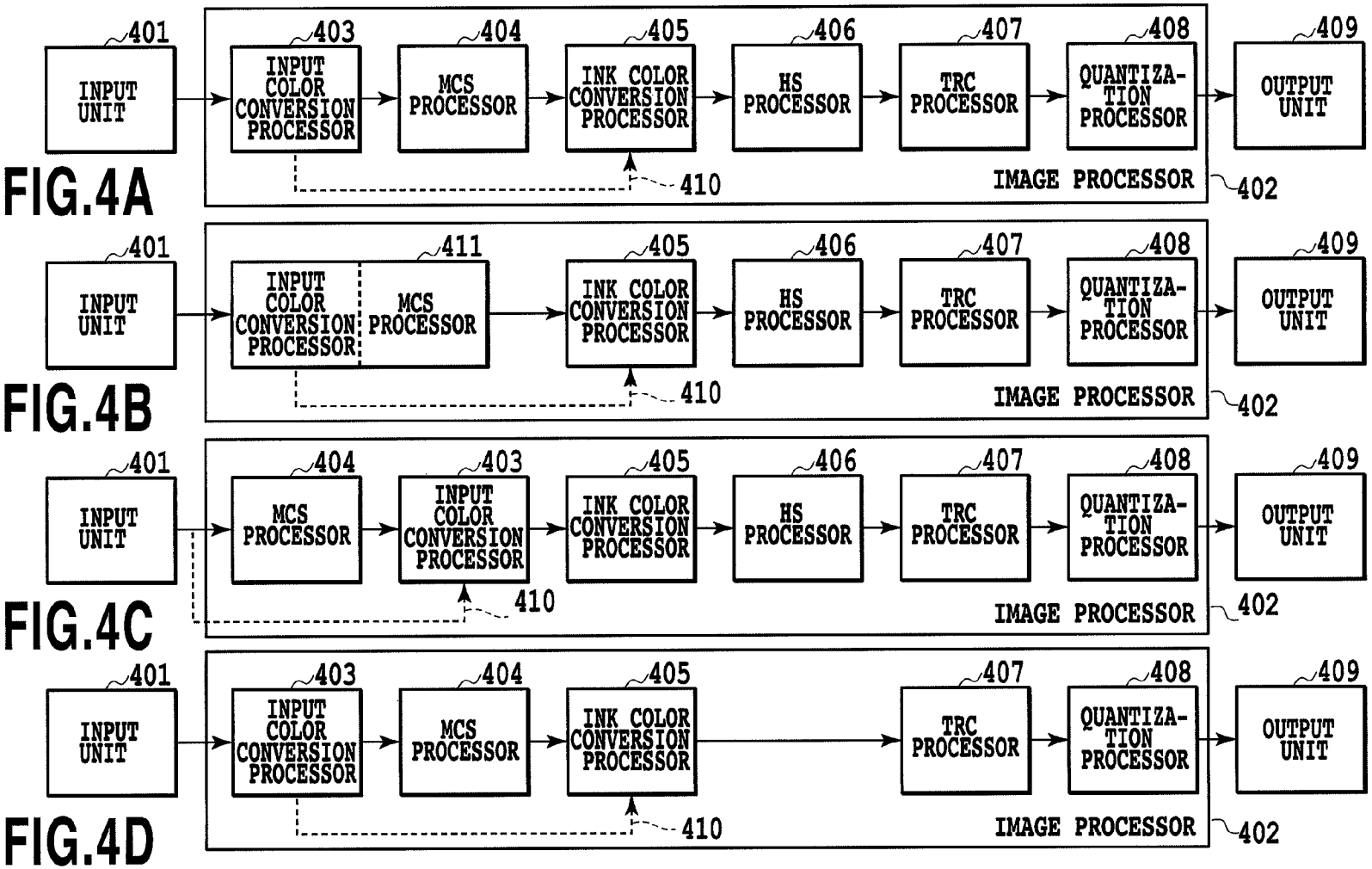
FIGS. 4A to 4D are block diagrams illustrating configurations of image processing operations executed by an inkjet printer to which the present invention may be applied.

FIG. 4A is a block diagram illustrating a configuration of image processing operations executed by an inkjet printer in accordance with the first embodiment of the present invention. In other words, in the present embodiment, an image processor is realized by means of various components for executing the controls and processes of the printer 100 illustrated in FIG. 2. However, it should be appreciated that the application of the present invention is not limited to such an embodiment. For example, the image processor may also be realized in the PC 300 realized in FIG. 2. Alternatively, a part of the image processor may be realized in the PC 300, with the other parts realized in the printer 100.

As illustrated in FIG. 4A, the input unit 401 takes image data received from the host PC 300, and outputs the image data to the image processor 402. The image processor 402 includes an input color conversion processor 403, an MCS processor 404, an ink color conversion processor 405, an HS processor 406, a TRC processor 407, and a quantization processor 408.

In the image processor 402, first the input color conversion processor 403 takes the input image data received from the input unit 401, and converts the data into image data compatible with the printer's color reproduction range. In the present embodiment, the input image data is data that indicates color coordinates (R, G, B) in a color coordinate space, such as the sRGB space used for expressing color on monitors. By using an established technique availing of such as matrix operations, a 3D LUT, or other processing, the input color conversion processor 403 converts the input image data R, G, and B of 8-bit into image data (R', G', B') in the printer's color reproduction range. This image data is expressed as a color signal made up of three elements. In the present embodiment, the conversion process is conducted using a three-dimensional lookup table (LUT) in conjunction with interpolation operations. Also, in the present embodiment, the resolution of the 8-bit image data handled in the image processor 402 is 600 dpi, whereas the resolution of the binary data obtained by the quantization of the quantization processor 408 is 1200 dpi, as described later.

The MCS (multi-color shading) processor 404 corrects the image data that has been converted by the input color conversion processor 403. As described later, this correction process also uses a correction table made up of a three-dimensional lookup table. By means of this correction process, the color deviation described earlier can be reduced, even when there exist individual variations in the ejection characteristics among the nozzles of the print heads at the output unit 409. The specific contents of the table as well as the correction process executed by the MCS processor 404 that uses the table will be described later.

The ink color conversion processor 405 takes the image data containing the 8-bit R, G, and B that were processed by the MCS processor 404, and converts the image data into image data that is in accordance with the color signal data of the inks used by the printer. Since the printer 100 of the present embodiment uses black (K), cyan (C), magenta (M), and yellow (Y) inks, the RGB signal image data is converted into image data made up of 8-bit color signals for K, C, M, and Y, respectively. This color conversion is conducted using a three-dimensional lookup table in conjunction with interpolation operations, similarly to the process executed by the input color conversion processor described above. However, as described earlier, other conversion techniques such as matrix operations may also be used.

The head shading (HS) processor 406 accepts the ink color signal image data as input, and converts the respective 8-bit data for each ink color into ink color signal image data according to the individual ejection volumes of the nozzles that constitute the print heads. In other words, the HS processor 406 conducts a process that is similar to the head shading process of the related art. In the present embodiment, this HS process is conducted using a one-dimensional lookup table.

The TRC (tone reproduction curve) processor 407 takes the image data made up of respective HS-processed 8-bit ink color signals, and for each ink color, the TRC processor 407 corrects the ink color signals in order to adjust the number of dots printed by the output unit 409. Typically, the number of dots printed onto a print medium does not exist in a linear relationship with the optical density realized on the print medium as a result of that number of dots. Consequently, the TRC processor 407 corrects the respective image data of 8-bit signal so as to adjust the number of dots printed onto the print medium in keeping with a linear relationship.

The quantization processor 408 quantizes the 8-bit, 256-value image data for each ink color that was processed by the TRC processor 407, and generates binary data of 1-bit that, specify whether to print (1) or not print (0). The configuration of the quantization processor 408 is not particularly limited in the application of the present invention. For example, the quantization processor 408 may be configured to directly convert the 8-bit image data into binary data (dot data), or alternatively, the quantization processor 408 may first quantize the multi-value data into a multi-valued data of several-bit, and then convert the quantized results into the final binary data. The method used for the quantization process may be an error diffusion method, a dithering method, or some other halftoning process.

On the basis of the binary data (dot data) obtained by quantization, the output unit 409 prints by driving the print heads and ejecting ink of respective colors onto a print medium. In the present embodiment, the output unit 409 is realized by means of a printing mechanism provided with the nozzle arrays 101 to 104 illustrated in FIG. 1.

Figure 5A:
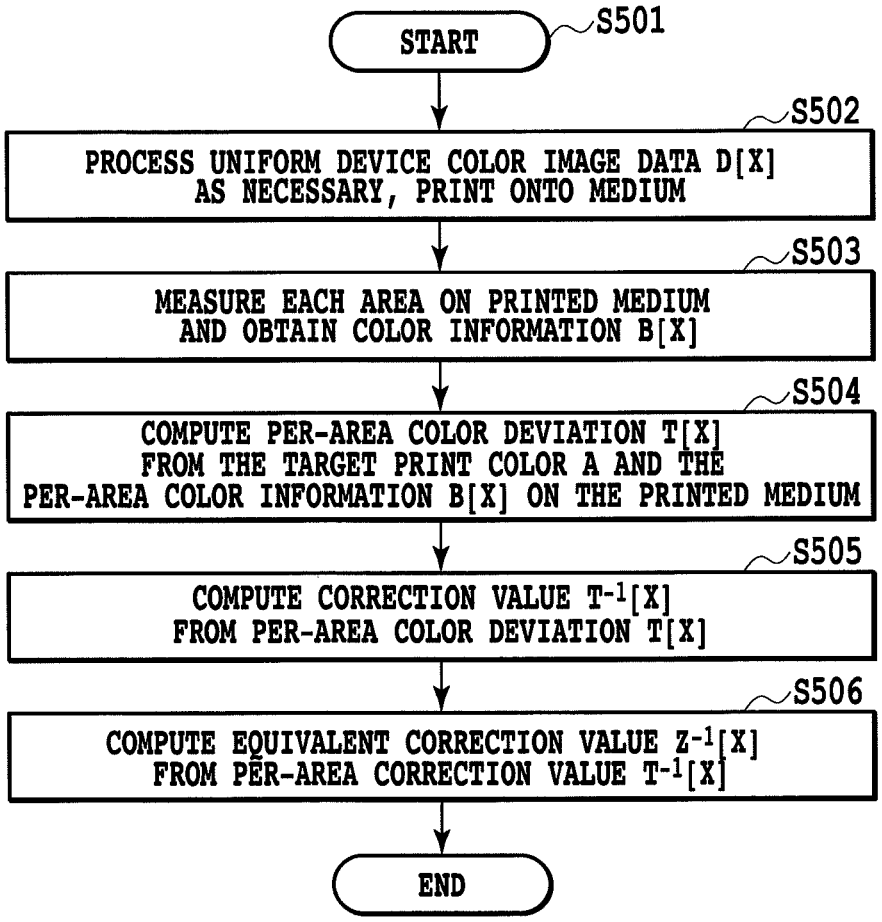
FIGS. 5A and 5B are flowcharts for explaining, respectively, a process for generating the parameters of a table used by an MCS processor, and a process for executing image processing using parameters generated at the actual time of printing.
Figure 5B:
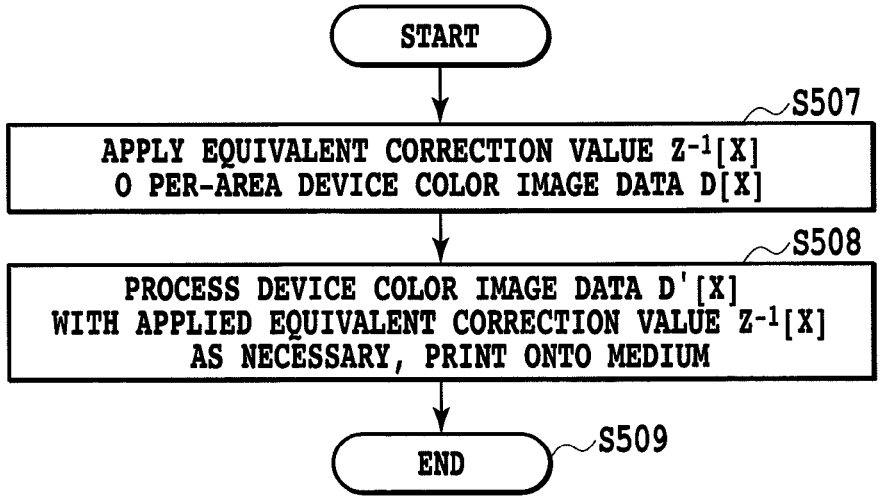

FIGS. 5A and 5B are flowcharts for explaining, respectively, a process for generating the parameters of a table used by the MCS processor illustrated in FIG. 4A, and a process for executing image processing using parameters generated at the actual time of printing.

FIG. 5A is a flowchart for explaining a process executed by the CPU 311 for generating the parameters of the three-dimensional lookup table used by the MCS processor 404. In the present embodiment, such a parameter generation process may be conducted at the time of manufacturing the printer, or as described later, at a suitable timing when color unevenness due to variation in ejection characteristics becomes a concern. This process can thus be conducted as a calibration process, and in so doing, the table parameters that make up the contents of the lookup table are updated. Moreover, as described later, since ink coloration on a print medium differs depending on the type of print medium, the present embodiment is configured to include separate lookup tables for each of a plurality of types of print media. For the sake of convenience, the series of operations for generating and setting correction parameters will be hereinafter referred to as calibration in the present specification.

FIG. 5B is a flowchart illustrating a process of an MCS processor 404, which is executed by the image processing accelerator 316 as one loop in the image processing of the image processor 402 illustrated in FIG. 4A in order to generate print data used when the printer prints.

First, a process for generating the table parameters illustrated in FIG. 5A will be described. In the present embodiment, the table parameters for the MCS processor are created on the assumption that the table parameters for the HS processor 406 have been created. For this reason, at the time when step S501 of the present process is activated, the table parameters for the HS processor have already been generated (or updated) by an established method. Since the generation of table parameters for the HS processor involves suppressing density variations on the print medium for each ink, correction parameters are created so as to reduce the number of ejections from nozzles with large ejection volumes, and to increase the number of ejections from nozzles with small ejection volumes, for example. Consequently, when given the nozzles 10321 of the magenta head 103 illustrated in FIG. 3A, for example, parameters are created so as to reduce the number of dots to approximately ½, as illustrated in FIG. 3B. When given the cyan head 102, parameters are created so as to not change the number of dots, as illustrated in FIG. 3B. In this way, when generating or updating table parameters for the MCS processor in the present embodiment, table parameters for the HS processor are first completed. As a result, when generating correction parameters for the MCS processor, it becomes possible to suitably reduce color deviation due to individual variations in ejection characteristics among nozzles by means of the combined processes of the MCS processor and the HS processor.

When the table parameter generation process of the MCS processor is initiated, measurement images (i.e., patches) are first printed in step S502 by ejecting ink from all nozzles on each of the print heads illustrated in FIG. 1. In this case, the respective signal values from 0 to 255 for R, G, and B may be divided into 17 sections, for example, and individual patches may be printed for all 17×17×17 possible combinations (i.e., lattice points). In order to reduce memory and work time, a subset of lattice points that are particularly susceptible to significant color deviation due to ejection characteristics may be selected from among the above lattice points, and patches may be printed for just the combinations of R, G, and B that correspond to the selected lattice points. In the present embodiment, measurement images are printed for colors (i.e., lattice points) that have been determined to be RGB combinations for which the color deviation due to ejection volume equals or exceeds a predetermined threshold. The patch types (i.e., color signal combinations) and number are then determined according to processing load and available memory.

Hereinafter, a method for printing measurement images will be described in association with FIG. 4A. When printing patches, image data (R, G, B) for the selected combinations is input into the ink color conversion processor 405 as image data processed by the input color conversion processor 403 (hereinafter, this image data is referred to as device color image data D[X]), without passing through the MCS processor 404. This path is illustrated as the bypass path in FIG. 4A indicated by the broken line 410. This process involving a bypass path may also be conducted by preparing a table wherein input values equal output values, such that the device color image data D[X] is input into the MCS processor 404, but output with values that are equal to the input values regardless of X, for example.

Subsequently, processing similar to that of normal data is performed by the HS processor 406, the TRC processor 407, and the quantization processor 408, and measurement images are printed onto the printing paper 106 by the output unit 409. During this process, the image data for the measurement images expressed with (R, G, B) is converted into image data (C, M, Y, K) for ink color signals by the ink color conversion processor 405. At this point, if one of the image data for the measurement images is R=0, G=0, B=255, for example, then that color signal will be converted into the color signal (K, C, M, Y)=(0, 255, 255, 0) which is a image data indicating cyan and magenta are printed 100% respectively. Subsequently, by means of the processes of the HS processor 406 and thereafter, the image data (K, C, M, Y)=(0, 255, 255, 0) becomes the dot data illustrated in FIG. 3B and is printed. For the sake of simplicity in the following description, table parameters and their generation process will be described only for the parameters corresponding to the lattice point indicated by the image data for such a blue measurement image.

Herein, X is information indicating nozzle positions, in 4-nozzle units, in the X direction on the nozzle arrays 101 to 104 illustrated in FIG. 1. In the MCS processor of the present embodiment, processing is performed in divided units of four nozzles each, and image data is corrected in units of four nozzles each. Also, the device color image data D [X] herein represents the image data to be printed by the four nozzles corresponding to X for respective ink colors.

Figure 6A:
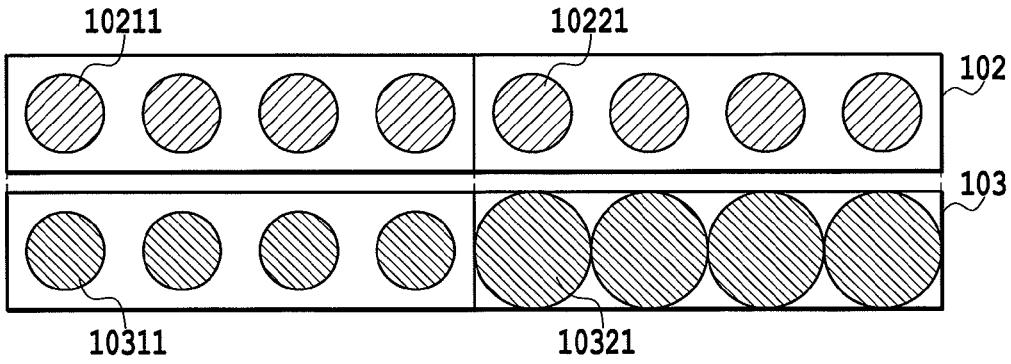
FIGS. 6A and 6B are diagrams for explaining the printed state of measurement images.
Figure 6B:
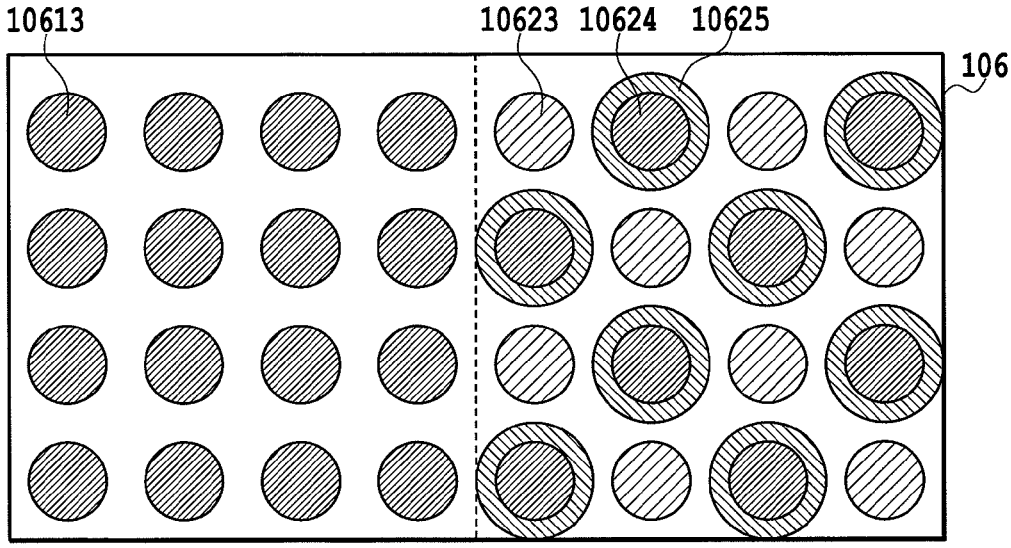

FIGS. 6A and 6B are diagrams for explaining the printed state of measurement images in the above step S502. In FIGS. 6A and 6B, elements that are similar to the elements illustrated in FIGS. 3A to 3C are given identical reference numbers, and further description of such elements is herein omitted.

Similarly to FIG. 3A, FIG. 6A illustrates the case where the four nozzles corresponding to the second area from among the nozzles on the magenta print head 103 have greater-than-standard ejection volumes. Consequently, a blue measurement image like that illustrated in FIG. 6B is printed as a result of the HS process performed on the image data (K, C, M, Y)=(0, 255, 255, 0) expressing blue. In other words, a patch is printed wherein color deviation is produced in the second area corresponding to nozzles with greater-than-standard ejection volumes, and wherein the color of the second area differs from the standard blue of the first area.

Referring back to FIG. 5A, in step S503, the measurement images that were printed on the printing paper 106 in step S502 are measured by the scanner 107, and color information B[X] (i.e., RGB data) corresponding to each area X is obtained. In the present embOdiment, the resolution of the scanner, that is the pitch of the scanning elements disposed in the scanner, is not particularly limited. The scanner resolution may be higher or lower than 1200 dpi, the print resolution of the print heads. Also, the scanner 107 is not limited to being full-line type like the print heads as illustrated in FIG. 1, and may instead be a serial type device that measures color at a predetermined period while moving along the x direction in FIG. 1. Alternatively, the scanner may be a physically separate device from the printer. In this case, the scanner and the printer may be connected via signals, with the measurement results from the scanner being automatically input. Furthermore, the color information B[X] is not limited to being RGB information, and may be in any format, such as L*a*b* values measured by a color meter, for example. Regardless of which format and which resolution are used to measure color, any technique may be applied to the present embodiment, as long as color measurement results B[X] are suitably obtained for areas corresponding to 4-nozzles sections by performing various processes such as averaging process for example.

In this way, a blue measurement image for the lattice point whose device color image data D[X] is (R, G, B)=(0, 0, 255) is printed by the cyan and magenta print heads 102 and 103 illustrated in FIG. 1. Subsequently, color information B[X] is obtained by the scanner 107 in units of areas corresponding to four nozzles each.

In the following description, the first area is taken to be X=1, the second area is taken to be X=2, the first area color information is taken to be B[1]=(R1, G1, B1), and the second area color information is taken to be B[2]=(R2, G2, B2).

In step S504, a color deviation quantity T[X] for each area [X] is computed from a target color A=(Rt, Gt, Bt) as well as the color information B[X] acquired in step S503. Herein, the target color A is a target measurement value in a case wherein a (R, G, B)=(0, 0, 255) signal is printed and measured with the printer in the present embodiment. The target color A may also be the actual color result measured by the scanner 107 for an image that has been printed using nozzles with standard ejection volumes.

In other words, the color deviation T can be expressed as follows:

$$\text{Color deviation } T[1]=B[1]-A=(R1-Rt, G1-Gt, B1-Bt)$$

$$\text{Color deviation } T[2]=B[2]-A=(R2-Rt, G2-Gt, B2-Bt)$$

In the present example, in the first area, both cyan and magenta have standard ejection volumes. For this reason, R1=Rt, G1=Gt, and B1=Bt, and the color deviation becomes T[1]=0 generally. In contrast, in the second area, cyan has a standard ejection volume, but magenta has a greater-than-standard ejection volume. For this reason, values different from the target colors (Rt, Gt, Bt) are inevitably detected. By way of example, consider R2<Rt, G2=Gt, and B2=Bt. In this case, the coloration is such that cyan is stronger compared to the standard blue color, and the color deviation becomes T[2]=((R2≠Rt≠0), 0, 0).

In the next step S505, a correction value $T^{-1}[X]$ is computed from the color deviation T[X] for each area [X]. In the present embodiment, correction values are simply obtained using the inverse transform $$T^{-1}[X]=-T[X].$$

Consequently, the respective correction values for the first and second areas become $$T^{-1}[1]=-T[1]=A-B[1]=(Rt-R1, Gt-G1, Bt-B1)$$

$$T^{-1}[2]=-T[2]=A-B[2]=(Rt-R2, Gt-G2, Bt-B2).$$

Herein, since T[1]=0, the correction value for the first area becomes $T^{-1}[1]=0$. In contrast, since T[2]=((R2−Rt≠0), 0, 0), the correction value for the second area becomes $T^{-1}[2]=((Rt-R2\neq 0), 0, 0)$. If R2<Rt, then Rt−R2 becomes a positive value, and thus the correction value strengthens red tint to reduce cyan. If the opposite is true and R2>Rt, then Rt−R2 becomes a negative value, and thus the correction value weakens red tint to increase cyan.

In step S506, an equivalent correction value $Z^{-1}[X]$ is computed from the correction value $T^{-1}[X]$ for each area. A equivalent correction value refers to a correction value for taking the correction value $T^{-1}[X]$ that was obtained in the measured color space, and realizing that correction value in the device color space used in the present embodiment. The equivalent correction values are also the table parameters of the MCS processor. For the first area, since the correction value in the color meter space is $T^{-1}[1]=0$, the equivalent correction value in the device color space is likewise $Z^{-1}[1]=0$. In contrast, for the second area, a non-zero value is obtained, and in the present example, a correction value that reduces cyan in the device color space is obtained.

Assuming that the color meter space and the device color space match completely, the equivalent correction values become $$Z^{-1}[1]=T^{-1}[1]=-T[1]=A-B[1](Rt-R1, Gt-G1, Bt-B1)$$

$$Z^{-1}[2]=T^{-1}[2]=-T[2]=A-B[2]=(Rt-R2, Gt-G2, Bt-B2).$$

However, the color spaces often do not match in typical situations, and thus color space conversion becomes necessary. At this point, if a linear transformation is possible between the two color spaces, then a matrix transformation like the following or other established techniques can be used to compute equivalent correction values.

$$Z^{-1}[1]=\begin{bmatrix} a1 & a2 & a3 \\ a4 & a5 & a6 \\ a7 & a8 & a9 \end{bmatrix} \times \begin{bmatrix} Rt-R1 \\ Gt-G1 \\ Bt-B1 \end{bmatrix} \quad \text{[Eq. 1]}$$

$$Z^{-1}[2]=\begin{bmatrix} a1 & a2 & a3 \\ a4 & a5 & a6 \\ a7 & a8 & a9 \end{bmatrix} \times \begin{bmatrix} Rt-R2 \\ Gt-G2 \\ Bt-B2 \end{bmatrix} \quad \text{[Eq. 2]}$$

Herein, a1 to a9 are transform coefficients for transforming the measured color space into the device color space.

In contrast, if a linear transformation is not possible between the two color spaces, then a three-dimensional lookup table or other established technique may be used to evaluate $$Z^{-1}[1]=F(Rt-R1, Gt-G1, Bt-B1)$$

$$Z^{-1}[2]=F(Rt-R2, Gt-G2, Bt-B2)$$

wherein F is a function for transforming the measured color space into the device color space, and wherein the transformation relationship of the lookup table is in accordance with this function F.

Also, if the relationship between the correction value $T^{-1}$ and the equivalent correction value $Z^{-1}[X]$ differ depending on the color, then a three-dimensional lookup table or other established technique may be similarly used to evaluate $$Z^{-1}[1]=F(Rt, Gt, Bt)-F(R1, G1, B1)$$

$$Z^{-1}[2]=F(Rt, Gt, Bt)-F(R2, G2, B2)$$

wherein F is a function for transforming the measured color space into the device color space.

In so doing, a table parameter for each area [X] corresponding to particular nozzles can be computed with respect to lattice points selected as the colors particularly susceptible to significant color deviation. Additionally, the table parameters for lattice points other than the above selected lattice points can be computed by interpolating between the selected lattice points. The method used to compute values by means of interpolation may be an established method, and further description thereof is herein omitted.

The table parameters for each lattice point (i.e., the equivalent correction values $Z^{-1}$ [X]) computed as above are stored in memory for each area [X] and in association with their lattice points (correction parameter configuration). The memory used to store values at this point is herein taken to be the HDD 303 of the host PC in the present embodiment, but may also be non-volatile memory provided inside the printer itself. In either case, the created table parameters are preferably handled so as to not be lost at power off or similar timings. With the above, the calibration process is terminated.

Steps in the process executed by the MCS processor 404 and illustrated in FIG. 5B will now be described. These steps are one portion of the steps executed by the image processing accelerator 316 during normal printing operations, and following the series of image processing operations illustrated in FIG. 4A. In FIG. 4A, these steps correspond to the steps executed in the MCS processor 404.

First, in step S507, the image processing accelerator 316 corrects the device color image data D[X] (i.e., the first color signal) by using the table parameters created as illustrated in FIG. 5A (i.e., by using the equivalent correction values $Z^{-1}$[X]).

At this point, it is first determined which of the above areas [X] includes the target pixel which is the pixel currently subject to image processing. In other words, the value of X is determined. At this point, although each area [X] corresponds to a region made up of four 1200 dpi nozzles, the pixel resolution in the image processing is 600 dpi. For this reason, each area X corresponds to two pixels in the X direction.

If the value X=n is obtained for the area [X] that contains the target pixel, then by referring to the table entries created with respect to this area [n], an equivalent correction value $Z^{-1}$[n] can be acquired from the (R, G, B) values expressed by the image data of the target pixel. For example, if the RGB values expressed by the image data of the target pixel represent blue (0, 0, 255), then the equivalent correction value $Z^{-1}$[n] for blue (0, 0, 255) is obtained with respect to the area [n] as described earlier. The equivalent correction value $Z^{-1}$[n] is then added to the target pixel image data according to the equation below, and corrected device color image data D'[X] (i.e., the second color signal) is obtained. In other words, the relationship between the first color signal D [X] and the second color signal D'[X] is as follows.

Device color image data $D'[1]=D[1]+Z^{-1}[1]$

Device color image data $D'[2]=D[2]+Z^{-1}[2]$

In this example, the equivalent correction value for the first area is $Z^{-1}[1]=0$. Consequently, D'[1]=D[1], and thus the correction of the image data in the first area is, in effect, not performed by the MCS processor. In contrast, the equivalent correction value for the second area is $Z^{-1}[2]\neq 0$. Consequently, correction is performed by the MCS processor such that cyan is reduced in D'[2] compared to D[2].

In the following step S508, the image processing accelerator 316 takes the device color image data D'[X] obtained in step S507, and performs processing corresponding to the ink color conversion processor 405, the HS processor 406, the TRC processor 407, and the quantization processor 408. Dots are then printed onto the printing paper 106 by the output unit 409 in accordance with the binary data obtained as a result of the above processing.

Figure 7A:
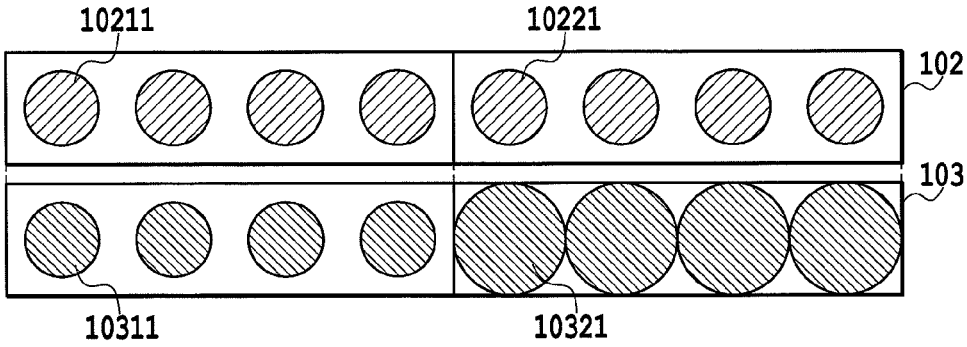
FIGS. 7A and 7B illustrate examples of images after an MCS process.
Figure 7B:
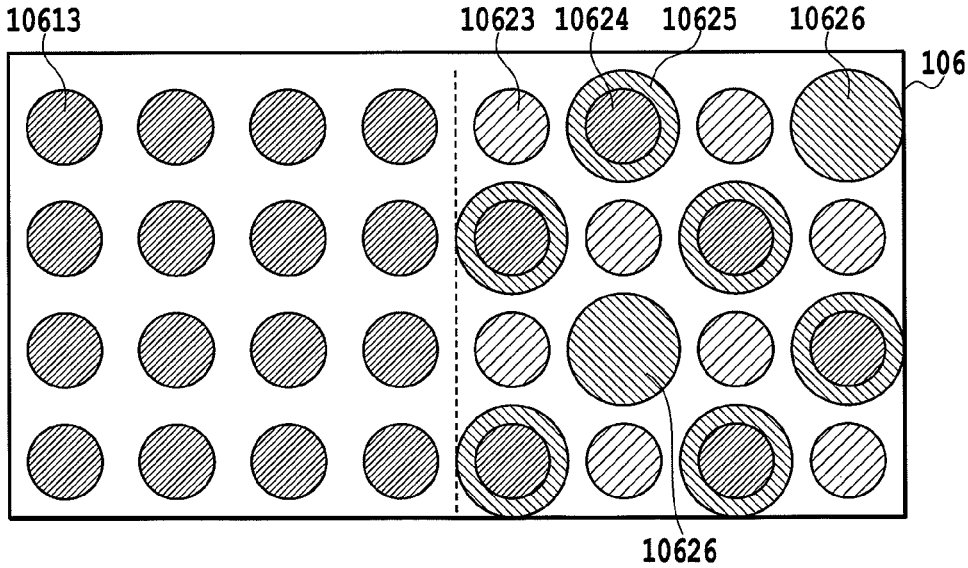

FIGS. 7A and 7B illustrate examples of images printed in step S508 of FIG. 5B. Similarly to FIG. 6A, FIG. 7A illustrates the nozzle ejection volume characteristics for the cyan and magenta print heads 102 and 103. FIG. 7B is a printed state of dots obtained as a result of conducting the MCS process of the present embodiment for comparing to the printed state of dots obtained as a result of conducting only the HS process illustrated in FIG. 6B. Given the state illustrated in FIG. 6B where only the HS process has been conducted, the second area is determined to have a strong cyan tint, and thus the MCS process is conducted so as to generate D'[2] with reduced cyan tint compared to D[2]. As a result, the number of cyan dots 10624 has been reduced compared to the printed state resulting from conducting only the HS process as illustrated in FIG. 6B.

In the first and second areas actually printed onto printing paper in accordance with D'[1] and D'[2], some degree of inevitable color deviation T[X] is produced due to ejection volume variation and other factors, but the resulting color is sufficiently close to the target color A.

Actual coloration in first area=Printed color corresponding to $D'[1]+T[1]\approx A$ Actual coloration in second area=Printed color corresponding to $D'[2]+T[2]\approx A$ Herein, D'[1] is ideally equivalent to the target color A, and T [1] is ideally 0. D'[2] is a blue color which is cyan-reduced color by amount equivalent to T [2] from the target color A, and T [2] is the amount of color deviation causing increased cyan. In this way, the blue colors in the first and second areas become nearly the same color, and the color unevenness due to a difference between the color deviations of two areas can be reduced.

As described above, the present embodiment is configured such that measurement images (i.e., patches) are printed onto a print medium for colors (i.e., combinations of R, G, and B) that are susceptible to significant color deviation, and table parameters are then computed on the basis of the measurement results. Typically, the susceptibility to color deviation depends on both (1) the color itself to be printed, and (2) the printing characteristics of the respective inks with respect to the print medium. Regarding (1), there is the issue of, for example, blue color deviation being more noticeable than red color deviation, even for equivalent variations in ejection volumes. Regarding (2), there are various factors that influence the size and density of dots as well as the coloration of respective inks in overlapping dots. In addition to ejection volumes, such factors can include the ejection direction, the dot shape, the permeability, and the type of print medium, for example.

Meanwhile, it is clear that the degree of color deviation for a particular color depends on the combination of the printing characteristics of the inks used to print that color, and does not depend on the printing characteristics of the inks that are not used. In other words, the type and number of related ink colors differs for each pixel, and thus it is possible in some cases that only a single ink will be related to particular pixels, and color deviation will not occur.

Also, although the foregoing describes, by way of example, a case where the four magenta nozzles contained in the same area all exhibit greater-than-standard ejection volumes, there is a significant possibility that the ejection characteristics for each nozzle inside a single area will all be different. However, it is still possible to achieve the advantages described above in such cases by acquiring the average color deviation for a given area, and processing so as to correct the color deviation by means of all four nozzles.

Meanwhile, data that can be expressed by the solid colors of the respective inks used by the printing apparatus is already adjusted in concentration by the HS process, and thus color deviation does not occur. Consequently, such colors do not need to be corrected by the MCS processor 404. Such a state will now be specifically described, taking by way of example the case where the measured color space and the device color space match completely.

If the measured color space and the device color space match completely, then the color signal (R=0, G=255, B=255) will be converted to (C=255, M=0, Y=0, K=0) in the ink color conversion processor. Since solid cyan (the C signal) is already suitably adjusted in density by the primary conversion of the HS process, it is better not to further modify the cyan data or add additional color data once the data has been adjusted by the HS process. In other words, in cases where such data exists, the equivalent correction values for the first and second areas should be $Z^{-1}[1]=Z^{-1}[2]=0=(0, 0, 0)$. The above similarly applies to 100% magenta data (R=255, G=0, B=255). In contrast, 100% blue data (R=0, G=0, B=255) is not data that can be expressed with the solid color of one of the inks used by the printing apparatus, and is instead expressed by a combination of cyan ink and magenta ink. Consequently, as already explained with the use of FIG. 3, there is a possibility that color deviation will occur, even if an HS process is conducted. For this reason, the equivalent correction values become $$Z^{-1}[1]=0=(0,0,0)$$

$$Z^{-1}[2]=T^{-1}[2]=(Rt-R2,Gt-G2,Bt-B2)\neq(0,0,0)$$

in the example illustrated in FIG. 6B, and suitable correction is conducted by means of an MCS process.

In this way, in a three-dimensional RGB space, there exist lattice points that require an MCS process, as well as lattice points that do not require an MCS process, with various degrees of correction depending on the signal value (i.e., the position of the lattice point). Consequently, when it is desirable to suppress color deviation across the entire color space, it is desirable to prepare correction signal values for the MCS process with respect to all RGB values expressed using two or more inks. However, printing and measuring patches for all RGB combinations, computing correction values, and preparing space to record the obtained correction values would lead to increased processing load, increased memory requirements, and increased processing time. Thus, it is preferable to select several colors in the RGB space that particularly require color deviation correction, print measurement images (patches) with signal values corresponding to those colors, and create a table containing the acquired equivalent correction values for each color, as in the present embodiment. However, in cases where the colors susceptible to significant color deviation are not particularly limited, then an embodiment may be configured as illustrated by way of example in FIG. 8, wherein correction values are computed for each of 27 lattice points taken at equally spaced coordinates in RGB space. In either case, patches may be printed for several specific color signals, and table parameters may be created on the basis of the correction values obtained from the patches. In so doing, an interpolation process can be conducted when actually printing an image, and parameters corresponding to the desired signal values can be prepared from the plurality of scattered parameter information.

In the table parameter generation method described earlier, table parameters are described as being created by computing the difference between a target color and the color meter results of an actually-printed patch. However, it should be appreciated that the method for generating correction parameters is not limited to the above. For example, from the measured results of the printed patches for each of the lattice points illustrated in FIG. 8, an outline in RGB color space expressed by the printing apparatus can be ascertained, signal values for realizing the target colors can be estimated, and these signal values may be taken to be the corrected data. This method will now be specifically described.

Figure 8:
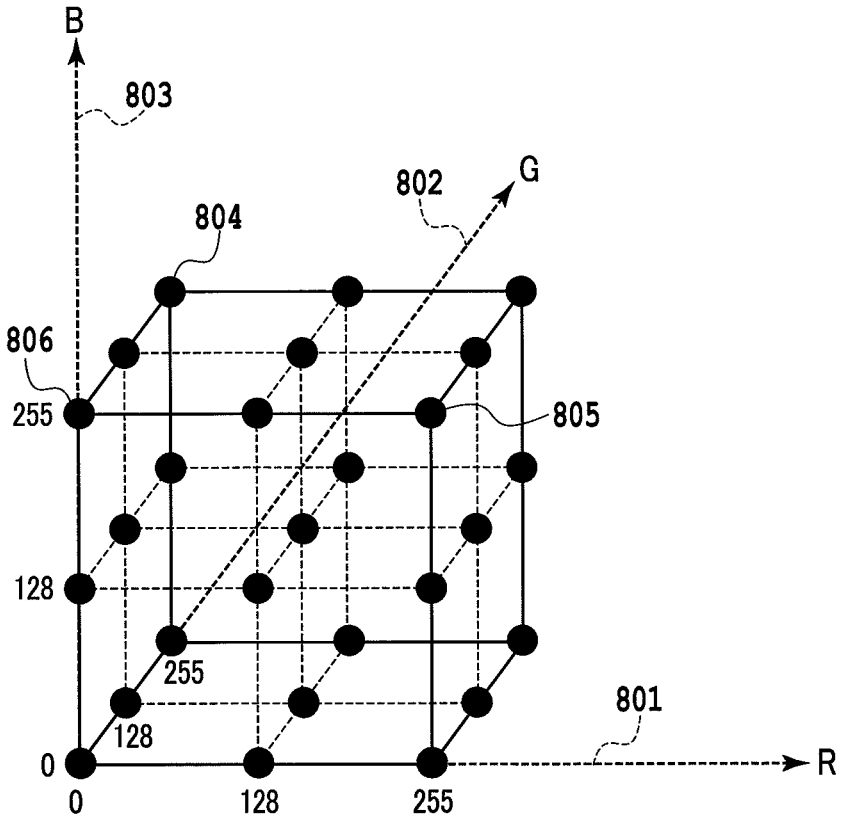
FIG. 8 illustrates lattice points taken at equally spaced coordinates in RGB space.

FIG. 8 illustrates the RGB color space, with 801 representing the red axis, 802 representing the green axis, and 803 representing the blue axis. The black circles represent 27 lattice points, each having red, green, and blue components that take one of the following values: 0, 128, or 255. In the present example, patches are printed on the basis of the respective signal values for these 27 lattice points, and color is measured on a per-area basis. The colors obtained from the color meter results are herein designated the device colors (Ri, Gi, Bi). By interpolating on the basis of the 27 device colors obtained from the 27 patches, a device color space for each area is obtained. Such device color spaces differ from the color space made up of equally spaced and parallel lines as illustrated in FIG. 8, and typically become color spaces with curved outlines. By using such device color spaces, it is possible to estimate device colors (Ri, Gi, Bi) for each area with respect to all target colors (Rt, Gt, Bt). The reverse is also true: it is possible to compute the signal values (Rn, Gn, Bn) for each area that should be input in order to best approximate the target colors (Rt, Gt, Bt). In other words, these device color spaces for each area can be used to create table parameters for converting input signals (Rt, Gt, Bt) into (Rn, Gn, Bn).

By conducting a calibration process, as well as an MCS process conducting at the time of actual printing, as described above, it becomes possible to reduce color unevenness produced by individual variations in the ejection characteristics among nozzles.

Meanwhile, as described earlier in relation to the related art, nozzle ejection characteristics and the degree of color unevenness change according to the frequency and cumulative number of ejections from the individual nozzles. Consequently, in order to maintain favorable images without noticeably color unevenness by a printer used over a moderately long period of time, it is preferable to repeatedly conduct a calibration process like that illustrated in FIG. 5A. At the same time, it is also desirable to avoid over-frequent calibration, which will expend more ink, print media, and calibration time than is necessary. On the other hand, it is difficult for the user to suitably determine when to calibrate before color unevenness appears in actual images. Consequently, in the present embodiment, an image processing apparatus executes calibration at suitable timings by predicting changes in the ejection characteristics of individual nozzles on the print heads.

Figure 9:
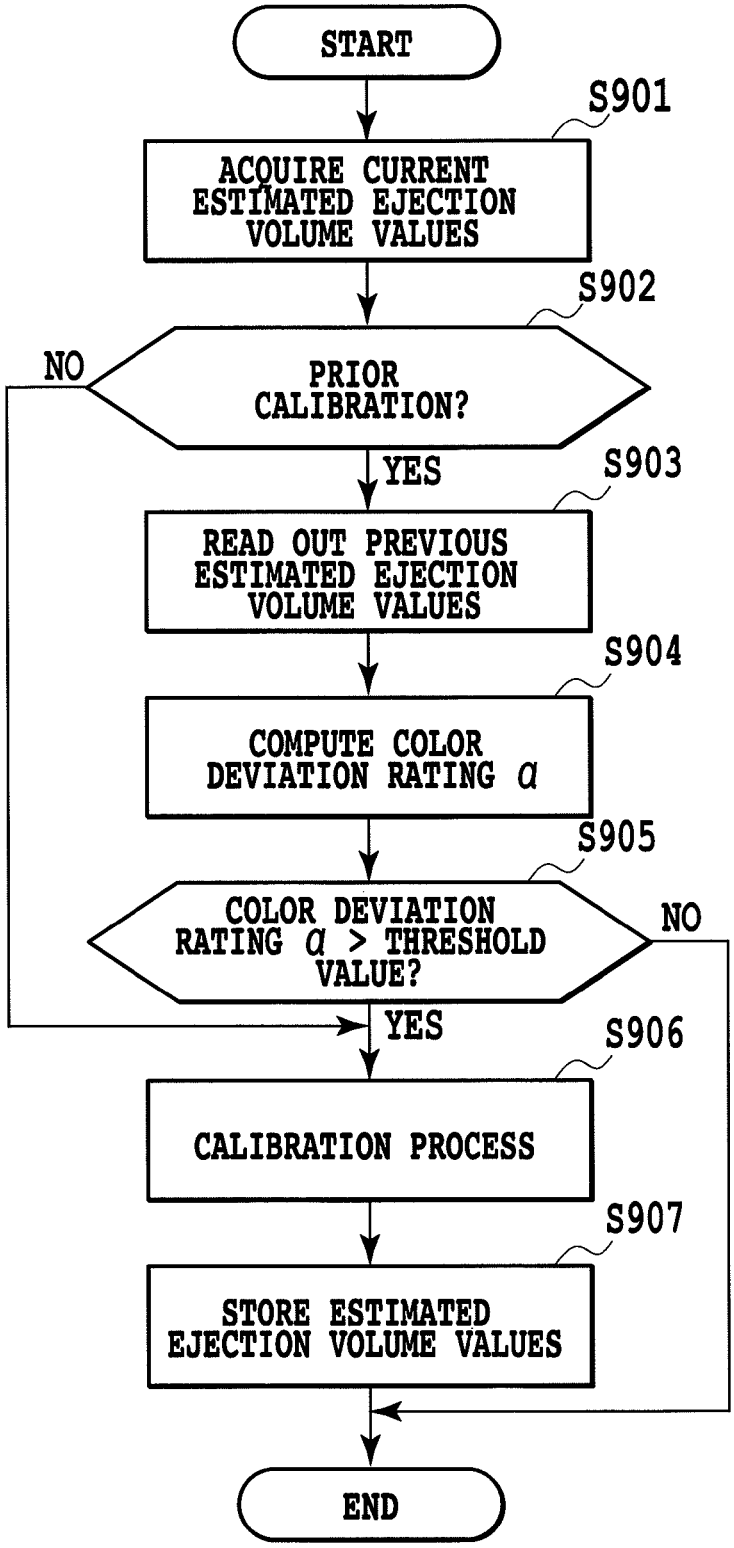
FIG. 9 is a flowchart illustrating a calibration execution determination process.

FIG. 9 is a flowchart illustrating a calibration execution determination process executed by the CPU 311 of a printer. This determination process may be executed when the apparatus is powered on, once a predetermined amount of time has elapsed since the last determination process, or once a predetermined print volume (i.e., a number of pages of print media or a quantity of ink) has been printed, for example.

When the process is initiated, in step S901 the CPU 311 first acquires current values for the estimated ejection volume of individual nozzle regions. The acquisition method may involve, for example, printing specific patterns onto a print medium such that the density distribution of the nozzles arranged on the print heads can be ascertained. The density distribution of the printed pattern may then be scanned by the scanner 107 illustrated in FIG. 1. In this case, a table is prepared in advance wherein scanned densitys and estimated ejection volume values are associated in a 1-to-1 relationship. By referencing this table, the scan results can be converted into estimated ejection volume values. Herein, the current value of the estimated ejection volume for cyan in the nozzle region X is taken to be Clat[X]. Similarly, magenta is given by Mlat[X], yellow by Ylat[X], and black by Klat[X].

In the following step S902, the CPU 311 determines whether or not calibration has been executed previously. For example, when executing the calibration process for the first time, a flag or other marker may be set after the operations illustrated in FIG. 5A. The CPU 311 is then able to make the above determination according to the state of the flag. If it is determined in step S902 that the calibration process has been executed previously, then the process proceeds to step S903. In contrast, if it is determined that the calibration process has not been executed previously, then the process jumps to step S906.

In step S903, the estimated ejection volume values for the individual nozzle regions on each print head that were stored at the time of the last calibration are read out. These estimated ejection volume values are not particularly limited to being physical quantities in units that express actual ink mass or volume, and may instead be values corresponding to ejection volumes in the individual nozzle regions, which may be converted into indicators of the relative degree of color deviation in individual nozzle regions by means of various conversion processes hereinafter described. Furthermore, since the estimated ejection volume values are read out and overwritten each time the present process is conducted, the values may be stored in an updateable memory area, such as the HDD 303 if the process is executed by the PC 300, or the RAM 312 if the process is executed by the printer 100 itself. Herein, the previous value of the estimated ejection volume for cyan in the nozzle region X is taken to be Cprev[X]. Similarly, magenta is given by Mprev[X], yellow by Yprev[X], and black by Kprev[X].

In the following step S904, the difference (i.e., displacement) is computed between the current values of the estimated ejection volumes acquired in step S901, and the previous values of the estimated ejection volumes acquired in step S903, for each individual nozzle region. In other words, $$dc[X]=Cprev[X]-Clat[X]$$

$$dm[X]=Mprev[X]-Mlat[X]$$

$$dy[X]=Yprev[X]-Ylat[X]$$

$$dk[X]=Kprev[X]-Klat[X]$$

wherein the absolute value of dc[X] is the displacement in the estimated ejection volume (i.e., the amount of change in the ejection volume) for cyan ink in the nozzle region X from the time of the last calibration to the present. Additionally, the total change in ejection volume for all inks a[X] is computed for all nozzle regions:

$$\alpha[X]=|dc[X]|+|dm[X]|+|dy[X]|+|dk[X]|$$

The maximum change in ejection volume α[X] among all nozzle regions X is also computed, and this value is taken to be the color deviation rating α. In other words, the color deviation rating α can be expressed as $$\alpha=\max(\alpha[1],\alpha[2],\alpha[3],\ldots,\alpha[Xmax])$$

where Xmax corresponds to the total number of nozzle regions included on the print heads.

As the color deviation rating a increases, the estimated ejection volume values increase for one of the plurality of nozzle regions, which indicates the existence of a region for which color unevenness may be a concern.

In step S905, it is determined whether or not the color deviation rating a has exceeded a predetermined threshold value. If the color deviation rating a has exceeded the predetermined threshold value, then it is determined that calibration is required, and the process proceeds to step S906. In contrast, if the color deviation rating a has not exceeded the predetermined threshold value, then it is determined that calibration is not yet required, and the process is terminated.

In step S906, a calibration process is executed according to the operations illustrated in FIG. 5A.

In the following step S907, the estimated ejection volume values acquired in step S901 are stored in a predetermined memory area, and the process is then terminated.

In the above description, α[X] is defined as the total change in ejection volume, or in other words, as the linear combination of changes in the ejection volumes for respective inks. However, α[X] may also be defined as a polynomial like the following:

$$\alpha[X]=a\times[dc[X]]^2+b\times[dm[X]]^2+c\times[dy[X]]^2+d\times[dk[X]]^2$$

where a, b, c, and d are constants.

In addition, the degree of color unevenness due to ejection volume variation changes in a continuous and complex way depending on the hues to be presented. Consequently, in practice, the parameter α[X] used to evaluate the degree of color unevenness cannot be accurately defined by using a linear or quadratic formula with respect to the values acquired by the scanner as described above. Given these circumstances, α[X] may also be directly found from the per-color changes in ejection volumes by preparing a four-dimensional CMYK lookup table in advance. This conversion can be expressed as $$\alpha[X]=4D_LUT[dC[X]][dM[X]][dY[X]][dK[X]].$$

The above four-dimensional lookup table can be created in advance at the laboratory level by measuring color in a plurality of test patterns that are printed for differentiating in the per-color ejection volumes each other. If such a four-dimensional lookup table is prepared, a highly reliable α[X] adhering to actual measured values can be derived from the changes in ejection volumes.

The following will specifically describe why the degree of color unevenness due to ejection volume variation changes continuously depending on the hue.

Figure 13:
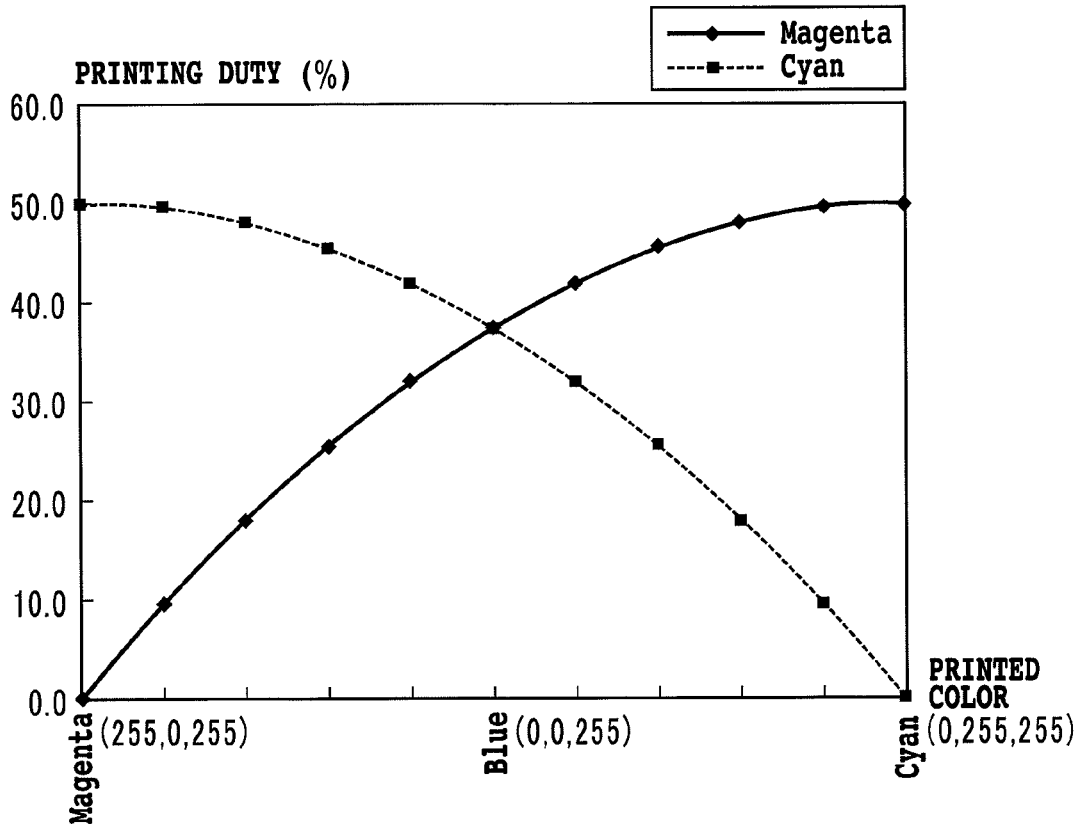
FIG. 13 illustrates the relationship between signal values input into an ink color converter and printing duties.

FIG. 13 illustrates the relationship between partial input signal values (RGB) input into the ink color conversion processor illustrated in FIG. 4A, and the results of converting the output signal values to the TRC into printing duties. Herein, the respective printing duties for cyan ink and magenta ink, with respect to the color region from magenta (255, 0, 255) to blue (0, 0, 255), to cyan (0, 255, 255), are represented. Printing duty refers to ratio of pixels adopted with ink droplets of standard ejection volume versus the total number of pixels arrayed in the printing resolution of the printer. Consequently, in the state where all pixels are printed with one dot each of cyan ink with a standard ejection volume, the cyan printing duty becomes 100%. As FIG. 13 demonstrates, the printing duty is 50% magenta and 0% cyan in the magenta region, gradually changing in the direction of the blue region, with both magenta and cyan becoming 37.5% in the blue region. In the cyan region, the printing duty becomes 0% magenta and 50% cyan. In this way, the ink printing duties smoothly changes according to hue.

Table 1 illustrates the changes in printing duties with respect to a print medium for the case when the cyan and magenta ejection volumes have changed from their standard ejection volumes.

TABLE 1

Combinations of Ejection Volume Changes and Printing Duty Changes

| | | | Printed Color | | | | | | | | | | |
|---|---|---|---|---|---|---|---|---|---|---|---|---|---|
| | | | Magenta (255, 0, 255) | | | | Blue (0, 0, 255) | | | Cyan (0, 255, 255) | | | |
| Printing duty (%) at standard ejection volume | | Cyan | 0.0 | 9.5 | 18.0 | 25.5 | 32.0 | 37.5 | 42.0 | 45.5 | 48.0 | 49.5 | 50.0 |
| | | Magenta | 50.0 | 49.5 | 48.0 | 45.5 | 42.0 | 37.5 | 32.0 | 25.5 | 18.0 | 9.5 | 0.0 |
| Change in printing duties when ejection volume changes | C + 15% | Cyan | 0.0 | 1.4 | 2.7 | 3.8 | 4.8 | 5.6 | 6.3 | 6.8 | 7.2 | 7.4 | 7.5 |
| | M + 0% | Magenta | 0.0 | 0.0 | 0.0 | 0.0 | 0.0 | 0.0 | 0.0 | 0.0 | 0.0 | 0.0 | 0.0 |
| | | Total | 0.0 | 1.4 | 2.7 | 3.8 | 4.8 | 5.6 | 6.3 | 6.8 | 7.2 | 7.4 | 7.5 |
| | C + 10% | Cyan | 0.0 | 1.0 | 1.8 | 2.6 | 3.2 | 3.8 | 4.2 | 4.6 | 4.8 | 5.0 | 5.0 |
| | M + 10% | Magenta | 5.0 | 5.0 | 4.8 | 4.6 | 4.2 | 3.8 | 3.2 | 2.6 | 1.8 | 1.0 | 0.0 |
| | | Total | 5.0 | 5.9 | 6.6 | 7.1 | 7.4 | 7.5 | 7.4 | 7.1 | 6.6 | 5.9 | 5.0 |
| | C + 0% | Cyan | 0.0 | 0. 0 | 0.0 | 0.0 | 0.0 | 0.0 | 0.0 | 0.0 | 0.0 | 0.0 | 0.0 |
| | M + 15% | Magenta | 7.5 | 7.4 | 7.2 | 6.8 | 6.3 | 5.6 | 4.8 | 3.8 | 2.7 | 1.4 | 0.0 |
| | | Total | 7.5 | 7.4 | 7.2 | 6.8 | 6.3 | 5.6 | 4.8 | 3.8 | 2.7 | 1.4 | 0.0 |

In Table 1, "Printing duty (%) at standard ejection volume" expresses the printing duties for cyan ink and magenta ink in FIG. 13. Meanwhile, "Changes in printing duties when ejection volume changes" expresses the changes in printing duties for three cases where the ejection volume of either cyan ink or magenta ink changes. In the first case, the ejection volume of cyan ink is increased by 15%. In the second case, the ejection volumes of both cyan ink and magenta ink are increased by 10%. In the third case, the ejection volume of magenta ink is increased by 15%. The changes in respective printing duties for cyan ink and magenta ink, as well as the exemplary change in the total change in printing duty for both cyan ink and magenta ink, are expressed for the above three printed colors.

As Table 1 demonstrates, the change in printing duties is largest for cyan (R=0, G=255, B=255) in the first case, blue (R=0, G=0, B=255) in the second case, and magenta (R=255, G=0, B=255) in the third case. In this way, the degree of color unevenness due to ejection volume variation changes continuously depending on the hues to be expressed.

Furthermore, the actual coloration on a print medium changes in a complex and non-linear way according to various factors, such as the interval between applications of a plurality of ink to the print medium. Methods that use a linear or polynomial formula as described earlier often lack sufficient accuracy in determining the degree of color unevenness. In contrast, if a four-dimensional LUT like that described earlier is prepared in advance at the laboratory level, then an $\alpha[X]$ adhering to actual measured values can be derived from the changes in ejection volumes by one-to-one, thereby making it possible to more accurately determine suitable timings for executing calibration.

However, a four-dimensional LUT inherently requires a large memory area, and it is furthermore preferable for such converting means to be provided with a separate LUT for each type of print medium. In this case, data for the calibration execution determination process will occupy a vast amount of memory, which is not very realistic in some cases. Thus, the choice between computing $\alpha[X]$ by using a linear or polynomial formula as described earlier, or by using a four-dimensional LUT, may be appropriately made according to the particular printer specifications, with a balance made between the accuracy of the calibration execution determination and factors such as available memory.

Meanwhile, it has been known that the actual coloration on a print medium also differs according to the type of print medium. Thus, it is preferable to prepare a separate conversion formula or poly-dimensional lookup table for each type of print medium. In the case of a four-dimensional LUT, if there are n types of print media, then $\alpha1[X]$, $\alpha2[X]$, . . . , $\alpha n[X]$ for each print medium can be expressed as follows:

$$\alpha1[X]=4D_LUT[\text{media\#1}][dC[X]][dM[X]][dY[X]][dK[X]]$$

$$\alpha2[X]=4D_LUT[\text{media\#2}][dC[X]][dM[X]][dY[X]][dK[X]]$$

$$\alpha n[X]=4D_LUT[\text{media\#}n][dC[X]][dM[X]][dY[X]][dK[X]]$$

Additionally, if the $\alpha[X]$ of the printer is taken to be the maximum value from among $\alpha1[X]$, $\alpha2[X]$, $\alpha n[X]$ corresponding to the n types of print media, then $\alpha[X]$ can be expressed as follows:

$$\alpha[X]=\max(\alpha1[X],\alpha2[X],\alpha3[X],\alpha n[X])$$

In this way, by preparing a separate four-dimensional table or conversion formula for each of a plurality of print medium, it becomes possible to suppress the occurrence of color unevenness in advance for all print medium supported by the printing apparatus. Furthermore, if $\alpha i[X]$ (where i equals 1 to n) is managed for each print medium as described above, then the calibration execution determination process can flexibly accommodate increases or decreases in the types of print medium without any large-scale modifications.

In the foregoing, $\alpha i[X]$ is required for individual print medium, and the maximum value from among these rating values is taken to be $\alpha[X]$. However, a printing apparatus may be configured to manage rating values for each print medium, and to determine whether or not to execute calibration for each of print timing, according to a type of print medium to be printed.

According to the embodiment described in the foregoing, specific patterns are printed such that the density distribution of the nozzles arranged on the print heads can be ascertained. From these density distributions, the variation in estimated ejection volumes values is computed, and thus by extension, the degree of color unevenness is estimated. The number of specific patterns printed in this case may be equal to the number of print heads, or in other words, the number of inks used. Consequently, the processing time at each stage as well as the amount of expended print medium and ink can be decreased compared to the case of actually executing a calibration process as illustrated in FIG. 5A by printing patches for all 17×17×17 combinations (lattice points), for example. In other words, by providing a calibration execution determination process as in the present embodiment, actual calibration is no longer conducted more frequently than is necessary, thereby making it possible to conserve ink and print medium as well as time.

In the present embodiment, changes in the ejection volumes of four colors are computed to estimate color unevenness and determine whether or not to execute calibration. However, an embodiment may also be configured to compute the changes in ejection volumes for a number of colors that is less than the number of ink colors used by the printing apparatus and to omit the calibration process for several colors. For example, it is possible to configure an embodiment to determine whether or not to execute calibration only for 100% blue from the changes in ejection volumes for cyan C and magenta M.

(Modification)

Human perception is more sensitive to color differences in adjacent regions than to color differences in separated regions. Thus, when given a region with almost no change in ejection volume, if there exists partial nozzle region with a large change in ejection volume, then color unevenness might be noticeable, even when the color deviation rating α is less than the threshold value. Furthermore, in cases where the ejection volume changes from one end of a nozzle array to the other by little and little, color unevenness might not be noticeable, even when the color deviation rating α is greater than the threshold value. In light of such circumstances, the present modification decides whether or not to execute calibration while also taking into account the relative differences in ejection volume variation among a plurality of nozzle regions.

Figure 10:
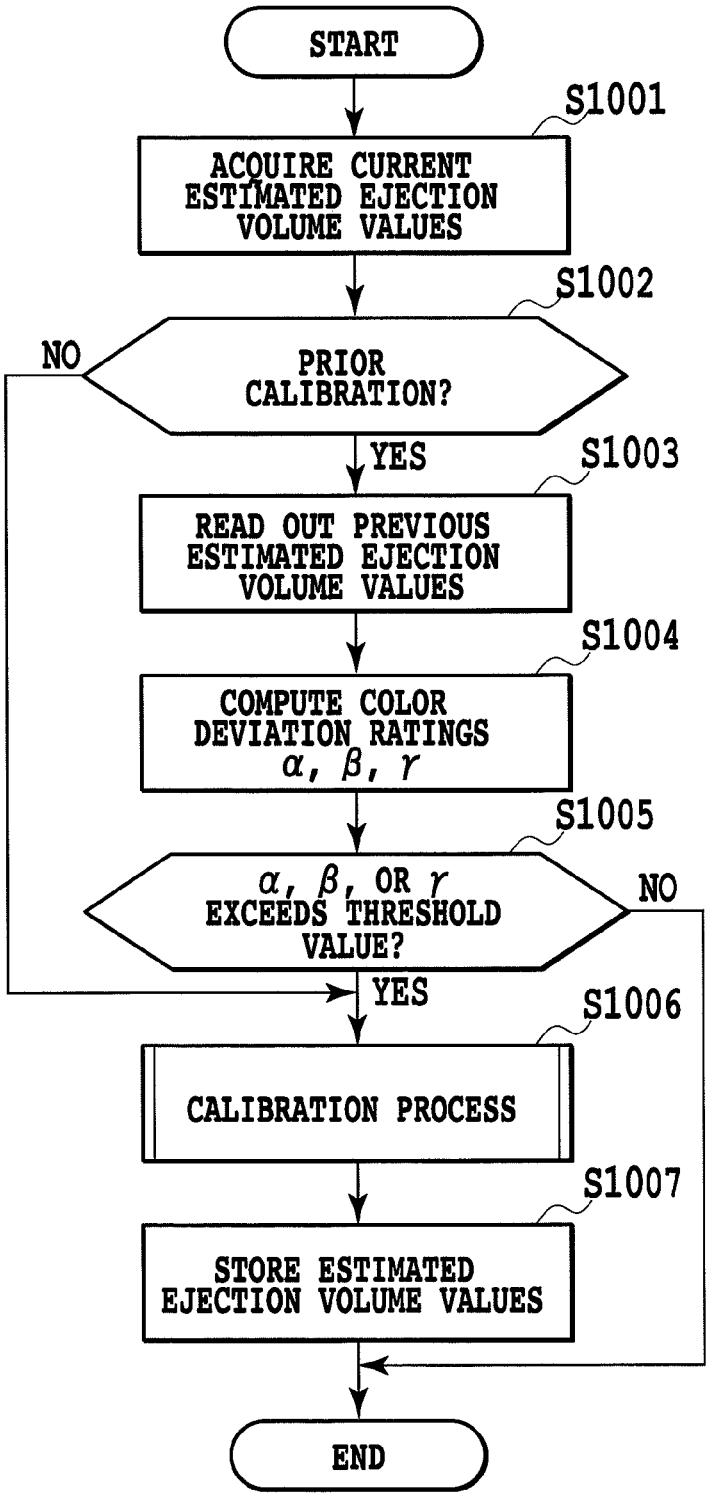
FIG. 10 is a flowchart illustrating a calibration execution determination process in accordance with a modification.

FIG. 10 is a flowchart illustrating a calibration execution determination process executed by the CPU 311 of a printer in accordance with the present modification. In FIG. 10, the operations from step S1001 to step S1003 are equivalent to the operations of the foregoing embodiment described in FIG. 9, and thus further description thereof is herein omitted.

In step S1004 of the present modification, three types of color deviation ratings α, β, and γ are computed. First, in the present modification, the color deviation rating α[X] is not taken to be the sum of the respective absolute values of dC[X], dM[X], dY[X], and dK[X], but is instead taken to be just the sum of these values:

$$\alpha[X]=dC[X]+dM[X]+dY[X]+dK[X]$$

In other words, α[X] in the present modification is a potentially negative value. Also, the color deviation rating a in the present modification is taken to be the maximum value among the absolute values of α[X] for all nozzle regions. In other words, the color deviation rating α becomes $$\alpha=\max(|\alpha[1]|,|\alpha[2]|,|\alpha[3]|,\ldots,|\alpha[X\max]|).$$

In contrast, the color deviation rating α is the value determined by the difference in the ejection volume change between a nozzle region and an adjacent nozzle region:

$$\beta[X]=\alpha[X]-\alpha[X-1]$$

and β can be expressed as $$\beta=\max(|\beta[1]|,|\beta[2]|,|\beta[3]|,\ldots,|\beta[X\max]|)$$

Additionally, the color deviation rating ã is the value determined by the difference between the maximum and minimum ejection volume changes. In other words, the color deviation rating γ can be expressed as $$\gamma=|\max(\alpha[1],\alpha[2],\alpha[3],\ldots,\alpha[X\max])-\min(\alpha[1],\alpha[2],\alpha[3],\ldots,\alpha[X\max])|.$$

In the present embodiment, respectively independent threshold values are prepared for these three color deviation ratings. Then, in step S1005 of FIG. 10, the three color deviation ratings are compared to their respective threshold values.

By way of example in the present modification, a case will now be described wherein the color deviation ratings α, β, and γ obtained by conversion from estimated ejection volume values are values corresponding to a color difference ΔE. Typically, perception of the color difference ΔE by the human eye occurs at approximately 0.8 to 1.5 for adjacent regions, and at approximately 1.5 to 3.2 for separated regions. From these characteristics, the threshold value for the color deviation rating α is set to 2, the threshold value for β is set to 1, and the threshold value for γ is set to 2 in the present modification. In other words, since the human eye is more sensitive to color differences in adjacent regions than color differences in separated regions, the threshold value for β is set to the smallest (i.e., strictest) value.

Returning now to FIG. 10, in step S1005, if any one of the three color deviation ratings exceeds its threshold value, execution of the calibration process is determined to be necessary, and the process proceeds to step S1006. In contrast, if all three color deviation ratings have not exceeded their predetermined threshold values, then it is determined that the calibration process is not yet necessary, and the process is terminated.

According to the modification described above, by preparing three types of color deviation ratings, the decision of whether or not to execute calibration can be made in a state closer to judgment by the human eye as compared to the foregoing embodiment. For example, if only the color deviation rating α is used as in the foregoing embodiment, then in order for color differences to go unnoticed even among adjacent regions, the threshold value for the color deviation rating α needs to be set to a stricter (i.e., smaller) value. As a result, calibration is determined to be executed, even when the large color difference is between separated regions and the color unevenness is not noticeable. In other words, calibration will be conducted at an extremely high frequency. However, if suitable threshold values can be prepared for each of α, β, and γ as in the present modification, calibration can be executed at more accurate timings when color unevenness would be perceived by the human eye.

Figure 11:
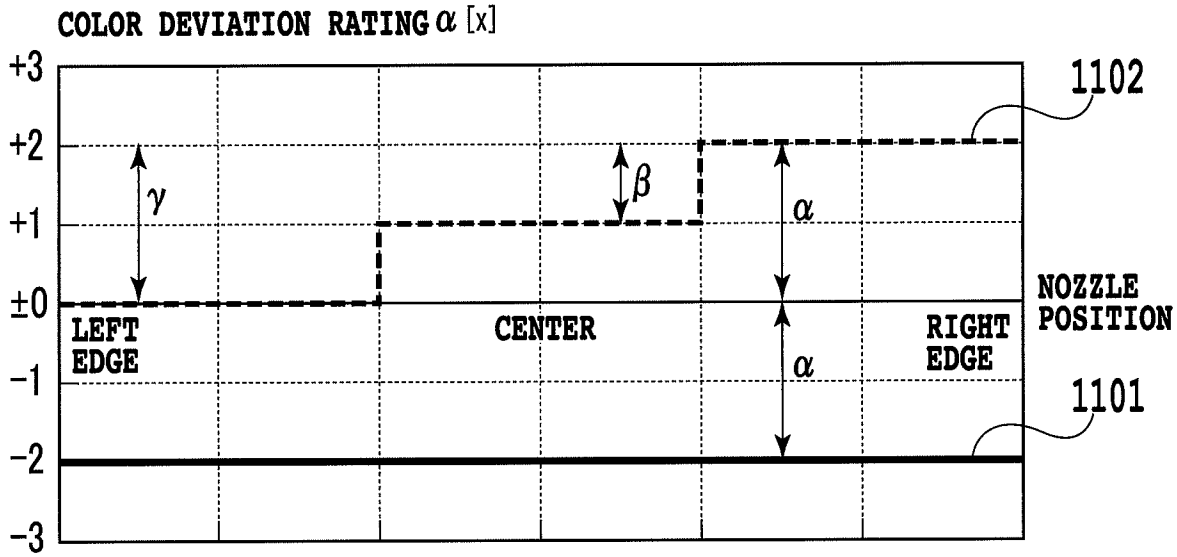
FIG. 11 illustrates two examples wherein a calibration process was determined to be unnecessary.

FIG. 11 illustrates two examples wherein a calibration process was determined to be unnecessary in the calibration execution determination process of the present modification. In FIG. 11, the horizontal axis represents the positions of a plurality of nozzles arranged on a print head, while the vertical axis represents the color deviation rating α[X] corresponding to each nozzle region. In FIG. 11, when the color deviation rating α[X] corresponding to each nozzle region is like that indicated by 1101, the color deviation ratings become α=2, β=0, and γ=0. As described earlier, the threshold values for α, β, and γ are 2, 1, and 2 in the present modification. For this reason, it is determined in step S1005 that not of the three color deviation ratings has exceeded its threshold value, and the calibration process is not executed. Meanwhile, when the color deviation rating α[X] corresponding to each nozzle region is like that indicated by 1102, the color deviation ratings become α=2, β=1, and γ=2. In this case, it is likewise determined in step S1005 that none of the three color deviation ratings has exceeded its threshold value, and the calibration process is not executed.

Figure 12:
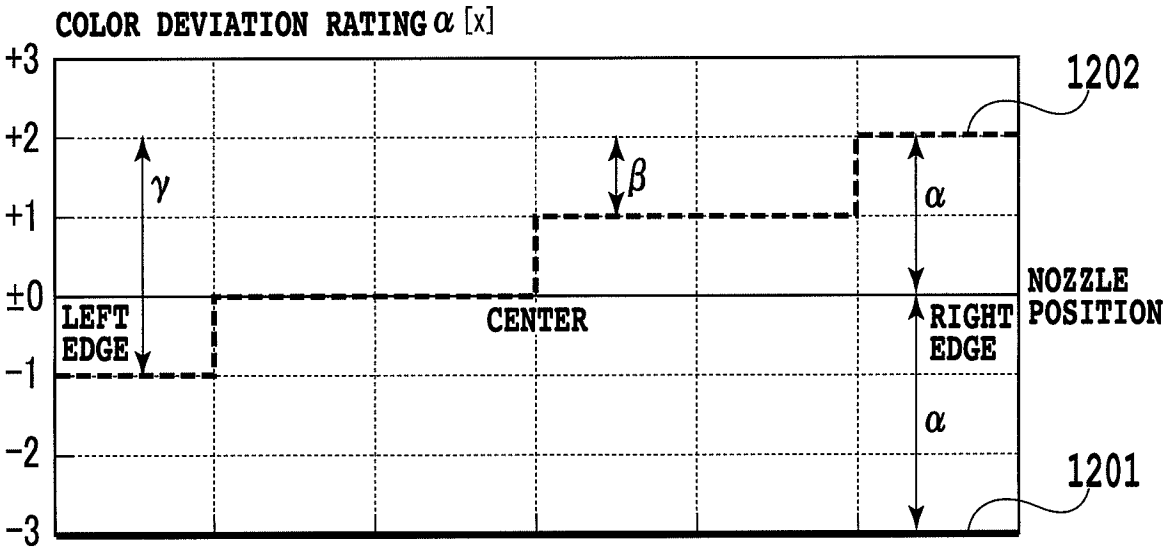
FIG. 12 illustrates two examples wherein a calibration process was determined to be necessary.

On the other hand, FIG. 12 illustrates two examples wherein a calibration process was determined to be necessary in the calibration execution determination process of the present modification. In FIG. 12, when the color deviation rating $\alpha[X]$ corresponding to each nozzle region is like that indicated by 1201, the color deviation ratings become $\alpha=3$, $\beta=0$, and $\gamma=0$. In this case, it is determined in step S1005 that although two of the three color deviation ratings ($\beta$ and $\gamma$) do not exceed their threshold values ($\beta=0<1$, $\gamma=0<2$), a does exceed its threshold value ($\alpha=3>2$), and thus the calibration process is executed in step S1006. Meanwhile, when the color deviation rating a[X] corresponding to each nozzle region is like that indicated by 1202, the color deviation ratings become $\alpha=2$, $\beta=1$, and $\gamma=3$. In this case, it is determined in step S1005 that although two of the three color deviation ratings ($\alpha$ and $\beta$) do not exceed their threshold values, $\gamma$ does exceed its threshold value ($\gamma=3>2$), and thus the calibration process is executed in step S1006.

When 1102 in FIGS. 11 and 1202 in FIG. 12 are compared, the color deviation ratings are $\alpha=2$ in both cases. Thus, when given an embodiment provided with only the single color deviation rating $\alpha$ and following the flowchart in FIG. 9, the calibration process will not be executed in either of the above cases. However, in the case of the present modification, by adopting the color deviation rating $\gamma$, the value of $\gamma$ becomes $\gamma=2$ in 1102 of FIG. 11 and $\gamma=3$ in 1202 of FIG. 12, and the calibration process is executed in the case of 1202. In this way, by adopting the new color deviation ratings $\beta$ and $\gamma$ in addition to the color deviation rating $\alpha$ using in the foregoing embodiment, the present modification is able to more accurately determine the state in which color unevenness would be perceived by the human eye, and is able to execute calibration at suitable timings.

In the present modification, the color deviation rating $\beta[X]$ for determining color deviation between adjacent nozzle regions is defined to be $\beta[X]=\alpha[X]-\alpha[X-1]$. However, $\beta[X]$ may be a value other than a simple difference of $\alpha[X]$. For example, $\beta[X]$ may also be defined in conjunction with an established technique for rating spatial edge strength, such as by filter processing or spatial frequency computation. In addition, although the present modification uses the color deviation rating a to compute the color deviation ratings $\beta$ and $\gamma$, a configuration for obtaining the advantages of the present modification is not limited to the above. A configuration is also possible wherein the color deviation ratings $\beta$ and $\gamma$ are computed directly from the ejection volume variation in each nozzle region without the use of the color deviation rating $\alpha$, as long as the resulting values can be used as indices of color deviation between adjacent nozzle regions or color deviation between separated nozzle regions.

Also, in the embodiment and modification described above, when it is determined that a calibration process is necessary in step S905 or step S1005, the calibration process is described as being automatically executed in step S906 or step S1006. However, the present invention is not limited to such configurations. In the present invention, the calibration execution determination process may simply be conducted prior to the calibration process, and calibration does not necessarily need to be conducted automatically. For example, an embodiment may be configured such that, when the calibration execution determination process determines that calibration is necessary, information prompting the user to execute calibration may be displayed, and calibration is then executed on the basis of the user's decision and instructions. Furthermore, an embodiment may be configured such that, when the user determines that a calibration process is necessary, the calibration process is executed directly, without conducting the calibration execution determination process.

Furthermore, although the foregoing embodiments describe, by way of example, a printer provided with print heads capable of ejecting inks of four colors as illustrated in FIG. 1, the present invention is obviously not limited to such combinations of inks. For example, it is also possible to use inks with lowered pigment concentrations, such as light cyan, light magenta, light yellow, and gray, or alternatively, it is possible to use inks with hues differing from CMYK, such as red, blue, green, orange, and violet, for example.

Also, referencing FIG. 4A, in the series of image processing operations described in the foregoing, the MCS processor 404 is positioned between the input color conversion processor 403 and the ink color conversion processor 405. However, the present invention is not limited to such a configuration. FIGS. 4B to 4D are block diagrams illustrating alternative examples of configurations of image processing operations applicable to the present invention. For example, FIG. 4B illustrates an example wherein the input color conversion processor 403 and the MCS processor 404 are configured as a single processing unit. FIG. 4C illustrates an example wherein the processing of the MCS processor 404 is performed before the processing of the input color conversion processor 403. Furthermore, FIG. 4D illustrates a configuration wherein the HS processor 406 provided in FIGS. 4A to 4C has been omitted. In any of the above configurations, it is possible to create a three-dimensional LUT for executing a suitable conversion process in each MCS processor by means of the calibration process, and thereby obtain advantages equivalent to those of the foregoing embodiments.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-225745, filed Oct. 5, 2010, which is hereby incorporated by reference herein in its entirety.

What is claimed is:

1. An image processor which processes input image data for printing an image on a plurality of regions of a print medium with the use of print heads provided with a plurality of nozzle arrays including a first nozzle array and a second nozzle array, the first nozzle array including first nozzles for ejecting first ink arranged in a predetermined direction and the second nozzle array including second nozzles for ejecting second ink, having a different color from the first ink, arranged in the predetermined direction, the image processor comprising:

a correcting unit configured to correct the input image data on the basis of a plurality of existing correction parameters, each of which corresponding to one of a plurality of nozzle groups and one of the plurality of regions, for converting the input data including a plurality of components into corrected image data including a plurality of components, for reducing color deviation of an image represented by the first ink and the second ink, and wherein each of the plurality of nozzle groups includes one of the first nozzles and one of the second nozzles which are capable of ejecting ink for the same region of the plurality of regions;

an acquiring unit configured to acquire, for each of the plurality of nozzle groups, a first ejection characteristic of the first nozzle and a second ejection characteristic of the second nozzle; and a determining unit configured to determine, for each of the plurality of regions, a necessity to generate a new correction parameter as a correction parameter which is used by the correcting unit to replace at least one of the existing correction parameters on the basis of both the first ejection characteristic and the second ejection characteristic acquired by the acquiring unit, wherein the first ejection characteristic indicates a first difference between a value indicating the ejection amount of the first ink acquired by the acquiring unit and a value indicating the previous ejection amount of the first ink that had been acquired when the existing correction parameters were generated, and wherein the second characteristic indicates a second difference between a value indicating the ejection amount of the second ink acquired by the acquiring unit and a value indicating the previous ejection amount of the second ink that had been acquired when the existing correction parameters were generated.

2. The image processor according to claim 1, further comprising:

a generating unit configured to generate the new correction parameter in a case where the determining unit determines that generation of the new correction parameter is necessary.

3. The image processor according to claim 1, further comprising:

a displaying unit configured to display information prompting a user to input instruction for generating the new correction parameter in a case where the determining unit determines that generation of the new correction parameter is necessary;

an inputting unit configured to accept the instruction input by the user for generating the new correction parameter; and a generating unit configured to generate the new correction parameter in accordance with the instruction from the inputting unit that is input by the user.

4. The image processor according to claim 1, further comprising a storage unit configured to store the existing correction parameters for each of a plurality of types of print medium.

5. The image processor according to claim 1, wherein the determining unit determines the necessity on the basis of a maximum value from among absolute values of the sum of the first difference and the second difference for each of the plurality of regions.

6. The image processor according to claim 5, wherein the determining unit determines that generation of the new correction parameter is necessary in a case where the maximum value is larger than a predetermined threshold.

7. The image processor according to claim 1, wherein the determining unit determines the necessity on the basis of a maximum value from among the sum of an absolute value of the first difference and an absolute value of the second difference for each of the plurality of regions.

8. The image processor according to claim 7, wherein the determining unit determines whether or not to generate the new correction parameter on the basis of a difference between the maximum value and the minimum value from among the sum of an absolute value of the first value and an absolute value of the second value for each of the plurality of regions.

9. The image processor according to claim 1, wherein the acquiring unit acquires the first ejection characteristic on the basis of a result of measuring a first test pattern that is printed by using the first ink, and acquires the second ejection characteristic on the basis of a result of measuring a second test pattern that is printed by using the second ink.

10. The image processor according to claim 1, wherein the existing and new correction parameters are parameters for correcting an amount of the first ink applied onto each of the plurality of regions and an amount of the second ink applied onto each of the plurality of regions.

11. The image processor according to claim 1, wherein the existing and new correction parameters are parameters for converting a color indicated by the input image data in a predetermined color space into a color different from the color in the predetermined color space.

12. The image processor according to claim 1, wherein the input data and the corrected image data include Red component, Green component and Blue component.

* * * * *